US006477338B2

(12) United States Patent
Hisano et al.

(10) Patent No.: US 6,477,338 B2
(45) Date of Patent: Nov. 5, 2002

(54) IMAGE FORMATION APPARATUS, TONER AMOUNT MEASUREMENT APPARATUS, AND TONER AMOUNT MEASUREMENT METHOD

(75) Inventors: Tohru Hisano, Kanagawa (JP); Kaoru Yoshida, Kanagawa (JP); Shinichi Ohashi, Tokyo (JP); Yoichi Watanabe, Kanagawa (JP); Kazuki Kitazawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/884,484

(22) Filed: Jun. 20, 2001

(65) Prior Publication Data

US 2002/0028082 A1 Mar. 7, 2002

(30) Foreign Application Priority Data

Sep. 4, 2000 (JP) ..... 2000-266666

(51) Int. Cl.[7] ..... G03G 15/00
(52) U.S. Cl. ..... 399/49; 399/38; 399/48
(58) Field of Search ..... 399/38, 46, 48, 399/49, 60, 73, 74; 324/457

(56) References Cited

U.S. PATENT DOCUMENTS 5,270,783 A * 12/1993 Bisaiji et al. ..... 399/48 X

FOREIGN PATENT DOCUMENTS

JP 6-66722 3/1994
JP 9-318598 * 12/1997

OTHER PUBLICATIONS

U.S. Pub. No. US 2001/0028804 A1; Hisano; Oct. 11, 2001; Toner Amount Measuring Apparatus and Method, and Image Forming Apparatus Using the Same.*

* cited by examiner

*Primary Examiner*—Sophia S. Chen
(74) *Attorney, Agent, or Firm*—Morgan, Lewis & Bockius LLP

(57) ABSTRACT

Light is applied by a laser diode 121 onto a photosensitive roll 110 formed with a developed toner image 161, the surface potential of the photosensitive roll 110 to which the light is applied is measured with a surface potential sensor 122, and the toner amount of the developed toner image 161 on the photosensitive roll 110 is derived based on the measured surface potential.

28 Claims, 27 Drawing Sheets

IMAGE FORMATION APPARATUS, TONER AMOUNT MEASUREMENT APPARATUS, AND TONER AMOUNT MEASUREMENT METHOD

BACKGROUND OF THE INVENTION

1. Field of the Invention

This invention relates to an image formation apparatus for finally forming a toner image on paper under an image formation condition that can be controlled, and a toner amount measurement apparatus and a toner amount measurement method for measuring a toner amount.

2. Background of the Invention

Hitherto, an image formation apparatus such as printers, copiers, and facsimile machines adopting electrophotography has been known. In such an image formation apparatus, light is applied to the surface of a photosensitive body for forming an electrostatic latent image and toner is deposited on the electrostatic toner image for development and then the toner deposited on the electrostatic toner image on the surface of the photosensitive body is transferred onto paper by means of a transfer device, a transfer belt, etc., whereby a toner image is finally formed on the paper. In such an image formation apparatus, to form a high-quality toner image, the amount of toner deposited on the photosensitive body or the transfer belt is measured with a toner amount measurement apparatus and the image formation condition applied for forming a toner image is controlled in response to the measured toner amount. An optical measurement method is widely known as a measurement method of the amount of toner deposited on the photosensitive body.

Here, the principle of a toner amount measurement method in a general toner amount measurement apparatus will be discussed with reference to FIGS. 1 to 4.

The surface of a photosensitive body or a transfer belt on which toner is deposited generally has a mirror structure high in flatness; hitherto, such a surface characteristic has been used to measure the toner amount in the toner amount measurement apparatus. Hereinafter, photosensitive bodies, transfer belts, etc., for supporting toner will be collectively called toner supports.

FIG. 1 is a drawing to show the measurement principle of a toner amount measurement method using specular reflection.

In the toner amount measurement method using specular reflection, light L1 of a predetermined strength is applied from a light source 2 such as a light emitting diode to the surface of a toner support 1 and is specularly reflected on the surface of the toner support 1 and reflected light L2 is received by a photosensor 3 such as a photodiode, which then outputs a voltage responsive to the strength of the received reflected light L2.

The reflected light L2 is blocked in the portion of the surface of the toner support 1 where toner is deposited, and as the reflected light L2 is blocked, the light reception amount of the photosensor 3 is lowered accordingly and the output voltage is lowered.

FIG. 2 is a graph to show the relationship between the toner deposition amount and the output voltage of the photosensor in the toner amount measurement method using specular reflection.

The graph shows on the horizontal axis the amount of toner deposited on the surface of the toner support and on the vertical axis the output voltage of the photosensor. The output voltage of the photosensor corresponds to the light amount of the specularly reflected light on the surface of the toner support, as described above.

As a curve 5 inclined downward to the right in the graph shows, the output voltage of the photosensor is lowered with an increase in the toner deposition amount. Since such a curve is previously found, the amount of toner deposited on the surface of the toner support can be found based on the relationship indicated by the curve 5 and the output voltage of the photosensor.

By the way, as for color toner, if light is applied to color toner, scattered light occurs because of reflection on the surface and in the inside of the color toner. A toner amount measurement method using such scattered light is also known.

FIG. 3 is a drawing to show the measurement principle of the toner amount measurement method using scattered light.

Also in the toner amount measurement method using scattered light, light L1 of a predetermined strength is applied from a light source 2 to the surface of a toner support 1 in a similar manner to that in FIG. 1; in the toner amount measurement method using scattered light, however, a photosensor 6 is provided at a position at a distance from the reflected light L2 shown in FIG. 1 and scattered light L3 caused by toner 4 deposited on the surface of the toner support 1 is received by the photosensor 6, which then outputs a voltage responsive to the strength of the received scattered light L3.

FIG. 4 is a graph to show the relationship between the toner deposition amount and the output voltage of the photosensor in the toner amount measurement method using scattered light.

Like the graph of FIG. 2, the graph of FIG. 4 shows the amount of toner on the horizontal axis and the output voltage of the photosensor on the vertical axis. The output voltage of the photosensor corresponds to the light amount of the scattered light caused by the toner.

As a curve 7 in the graph of FIG. 4 shows, the output voltage of the photosensor is raised with an increase in the toner deposition amount. Since such a curve 7 is previously found, the amount of toner deposited on the surface of the toner support can be found based on the relationship indicated by the curve 7 and the output voltage of the photosensor.

Most image formation apparatus in related arts measure the toner amount using either of the measurement principles shown in FIGS. 1 and 3 or measure the toner amount using both the measurement principles in combination.

By the way, with the toner amount measurement method using specular reflection, the measurement sensitivity is degraded if the surface of the photosensitive body or the transfer belt is completely covered with toner.

FIG. 5 is a graph to show the measurement sensitivity in the toner amount measurement method using specular reflection.

The graph shows the toner amount on a toner support on the horizontal axis and the light amount of specularly reflected light on the vertical axis. The inclination of the graph represents the measurement sensitivity.

As the toner amount increases, the inclination of the graph is lessened and in the toner amount exceeding 0.5 mg/cm$^2$, the inclination of the graph is extremely small. Thus, when the toner amount exceeds 0.5 mg/cm$^2$, if the toner amount changes, the light amount of the specularly reflected light scarcely changes and it is very difficult to measure the toner amount. However, the toner amount to be actually measured may extend to 0.5 mg/cm$^2$ or more on the photosensitive body, in which case the toner amount measurement method using specular reflection is not adequate.

On the other hand, with the toner amount measurement method using scattered light, the toner amount at up to 0.7 mg/cm$^2$ level can be measured. However, the toner amount measurement method using scattered light involves some problems. The first problem is that the method cannot be applied to measurement on black toner where scattered light does not occur. It is also desired that toner amount measurement be conducted on black toner like color toner; the fact that the amount of the black toner cannot be measured by the method involves a problem.

The second problem is that it is difficult to apply the toner amount measurement method using scattered light on the type of photo sensitive body currently mainstream for the reason described later.

FIG. 6 is a drawing to show the structure of a surface of the type of photosensitive body currently mainstream.

The surface of the photosensitive body has a structure wherein an undercoat layer 1_2, a charge generation layer 1_3, a charge transport layer 1_4, and an overcoat layer 1_5 are laid up in order on an aluminum base material 1_1. In the currently mainstream image formation apparatus, to form an electrostatic latent image on the photosensitive body having such a surface structure, laser light is applied to the photosensitive body surface for generating charges in the charge generation layer 1_3 and the charges are held in the charge transport layer 1_4, whereby an electrostatic latent image is formed.

If the aluminum base material $\mathbf{1}_{13}$ 1 has a smooth surface, the laser light incident through the photosensitive body surface and laser light reflected on the surface of the aluminum base material 1_1 interfere with each other and a desired electrostatic latent image cannot be provided. Thus, coarse surface working is conducted on the surface of the aluminum base material 1_1. If such a photosensitive body is used as a toner support and light L1 is made incident and scattered light L3 is received by the photosensor 6 as shown in FIG. 3, the photosensor outputs a voltage as described below:

FIG. 7 is a graph to show the relationship between the toner deposition amount and the outputs a voltage of the photosensor when the photosensitive body having the surface structure shown in FIG. 6 is used.

Like the graph of FIG. 4, the graph of FIG. 7 shows the amount of toner on the horizontal axis and the output voltage of the photosensor on the vertical axis, and the output voltage of the photosensor corresponds to the light amount of the scattered light caused by the toner.

When the toner deposition amount is small, the scattered light component from the base material surface of the photosensitive body is dominant and the scattered light has a high strength and the output voltage of the photosensor is high. As the toner deposition amount increases, the photosensitive body surface is covered with the toner and thus the scattered light from the base material surface decreases and the output voltage is lowered. When the toner deposition amount further increases, the scattered light component caused by the toner becomes dominant and as the toner deposition amount increases, the scattered light strength also increases and the output voltage is raised. Consequently, a curve 7' in the graph meanders and it is difficult to measure the true value of the toner amount based on the curve 7'. Thus, it is difficult to apply the toner amount measurement method using scattered light to the currently mainstream photosensitive body. This is the second problem involved in the toner amount measurement method using scattered light.

The toner amount measurement method using specularly reflected light and the toner amount measurement method using scattered light involve their respective problems as described above. Thus, in the image formation apparatus in the related art, the fact is that the image formation condition is controlled based on the toner amount measurement result on the photosensitive body for a toner image having a reasonably small toner amount, the result of measuring representatively the toner amount on any other than the photosensitive body, such as a transfer belt, or the like. However, to form a high-quality image, it is desired that the toner amount should be measured on the photosensitive body for a toner image having a large toner amount and that the image formation condition should be controlled based on the measurement result.

A method of sucking toner on the photosensitive body and measuring the weight of the toner is available as the method of measuring the toner amount for a toner image having a large toner amount on the photosensitive body. That is, the image formation apparatus is shut down and the photosensitive body on which toner is deposited is removed before the toner is sucked and the weight of the toner is measured. However, a machine using such a measurement method is large and is hard to be housed in an image formation apparatus. Since such a method involves removing parts in measurement, a large number of steps are required for measurement execution and it is extremely difficult to measure the toner amount while the image formation apparatus is operated.

SUMMARY OF THE INVENTION

It is therefore an object of the invention to provide an image formation apparatus capable of measuring the toner amount on a photosensitive body during the operation for a toner image having a high toner amount and a toner amount measurement apparatus and a toner amount measurement method capable of measuring the toner amount on a photosensitive body for a toner image having a high toner amount.

To the end, according to one aspect of the invention, there is provided an image formation apparatus comprising:

a photosensitive body;

a first light application section for applying light to a surface of the photosensitive body for forming an electrostatic latent image;

a developing section for depositing toner on the electrostatic latent image formed by the first light application section for developing the electrostatic latent image; and a transfer section for finally transferring onto paper a developed image into which the electrostatic latent image is developed by the developing section, thereby forming a toner image on the paper, wherein at least any one of the photosensitive body, the first light application section, the developing section, and the transfer section conforms to an image formation condition that can be controlled, characterized by:

a second light application section for applying light to the surface of the photosensitive body on which the toner is deposited;

a potential measurement section for measuring a surface potential of the photosensitive body to which the light is applied by the second light application section;

a toner amount derivation section for deriving the toner amount on the photosensitive body based on the surface potential measured by the potential measurement section; and a condition control section for controlling the image formation condition in response to the toner amount derived by the toner amount derivation section.

To the end, according to another aspect of the invention, there is provided a toner amount measurement apparatus comprising:

a light application section for applying light to a surface of a photosensitive body supporting toner on the surface;

a potential measurement section for measuring a surface potential of the photosensitive body to which the light is applied by the light application section; and a toner amount derivation section for deriving the toner amount on the photosensitive body based on the surface potential measured by the potential measurement section.

To the end, according to another aspect of the invention, there is provided a toner amount measurement method comprising:

a light application step of applying light to a surface of a photosensitive body supporting toner on the surface;

a potential measurement step of measuring a surface potential of the photosensitive body to which the light is applied at the light application step; and a toner amount derivation step of deriving the toner amount on the photosensitive body based on the surface potential measured at the potential measurement step.

DETAIELD DESCRIPTION OF THE PRESENT INVENTION

To describe embodiments of the invention, first the principle of the invention will be discussed and then specific embodiments will be described.

In the invention, light is applied to the surface of a photosensitive body on which toner is deposited for changing the potential on the surface of the photosensitive body, and the potential change is monitored, whereby the toner amount is measured. The description assumes that a toner patch image for control is formed on a photosensitive body, that the toner amount of the toner patch image is measured, and that an image formation condition is controlled based on the measurement result.

Figure 8:
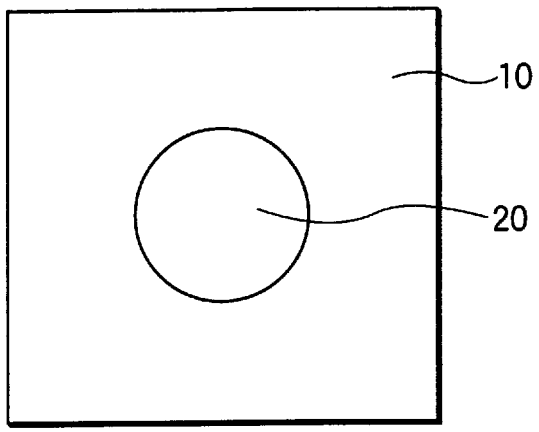
FIG. 8 is a drawing to represent a toner patch image on a photosensitive body.

FIG. 8 is a drawing to represent a toner patch image on photosensitive body.

A primary exposure area 10 shaped like a square on the surface of a photosensitive body is exposed to primary exposure light (laser light), whereby a square electrostatic latent image is formed. Toner is deposited on the electrostatic latent image and a toner patch image of the same shape as the primary exposure area 10 is formed. Secondary exposure light for measuring the toner amount is applied to a secondary exposure area 20 shaped like a circle at the center of the primary exposure area 10.

The behavior of the surface potential of the photosensitive body will be discussed.

Figure 9:
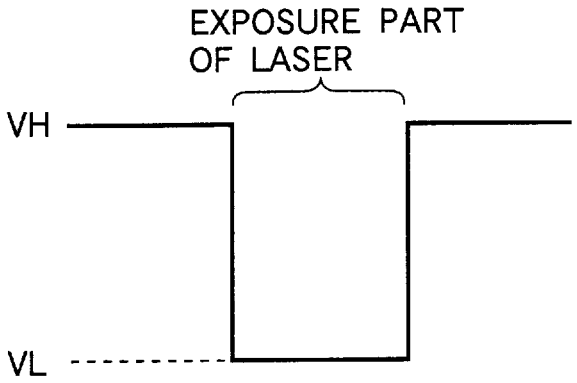
FIG. 9 is a drawing to represent the potential when an electrostatic latent image is formed.
Figure 10:
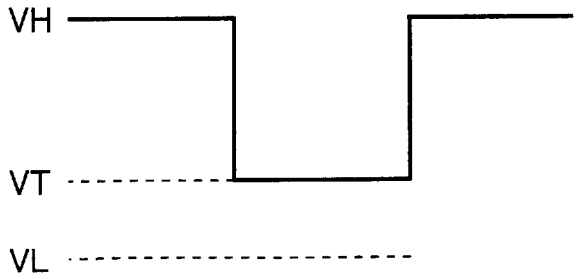
FIG. 10 is a drawing to represent the potential when a toner patch image is formed.
Figure 11:
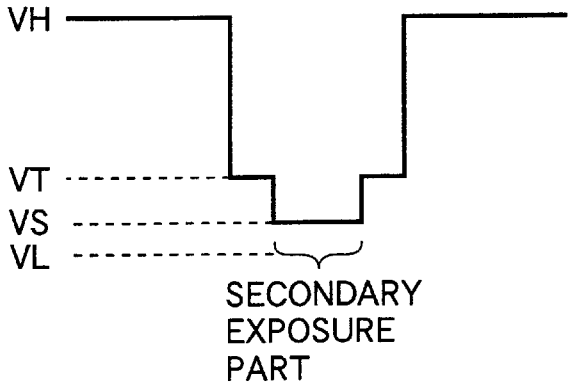
FIG. 11 is a drawing to represent the potential of the toner patch image after secondary exposure light is applied.

FIG. 9 is a drawing to represent the potential when the electrostatic latent image is formed. FIG. 10 is a drawing to represent the potential when the toner patch image is formed. FIG. 11 is a drawing to represent the potential of the toner patch image after the secondary exposure light is applied.

The surface of the photosensitive body is previously charged to predetermined background potential VH by a charger before primary exposure light is applied, and primary exposure light is applied to the charged surface. The exposure part to which the primary exposure light (laser light) is applied is diselectrified and becomes primary exposure potential VL responsive to the strength of the primary exposure light. The image drawn by a distribution of the primary exposure potential VL is the electrostatic latent image. Here, the above-mentioned square electrostatic latent image is formed and charged toner is selectively deposited on the electrostatic latent image by the electrostatic force, whereby the electrostatic latent image is developed to form the toner patch image.

The toner for developing the electrostatic latent image is charged to an opposite polarity to that of the primary exposure potential VL with the background potential VH as the reference so that it is selectively deposited only on the electrostatic latent image. Thus, when the toner patch image is formed, the primary exposure potential VL and the charges of the toner cancel each other out and toner image potential VT results.

Further, when secondary exposure light is applied to the toner patch image, it passes through the toner patch image in the transmittance responsive to the toner amount and arrives at a charge generation layer of the photosensitive body. Consequently, charges are generated in the charge generation layer and electricity is removed and a secondary exposure part becomes secondary exposure potential VS. Such potential change is represented as a graph of FIG. 12.

Figure 12:
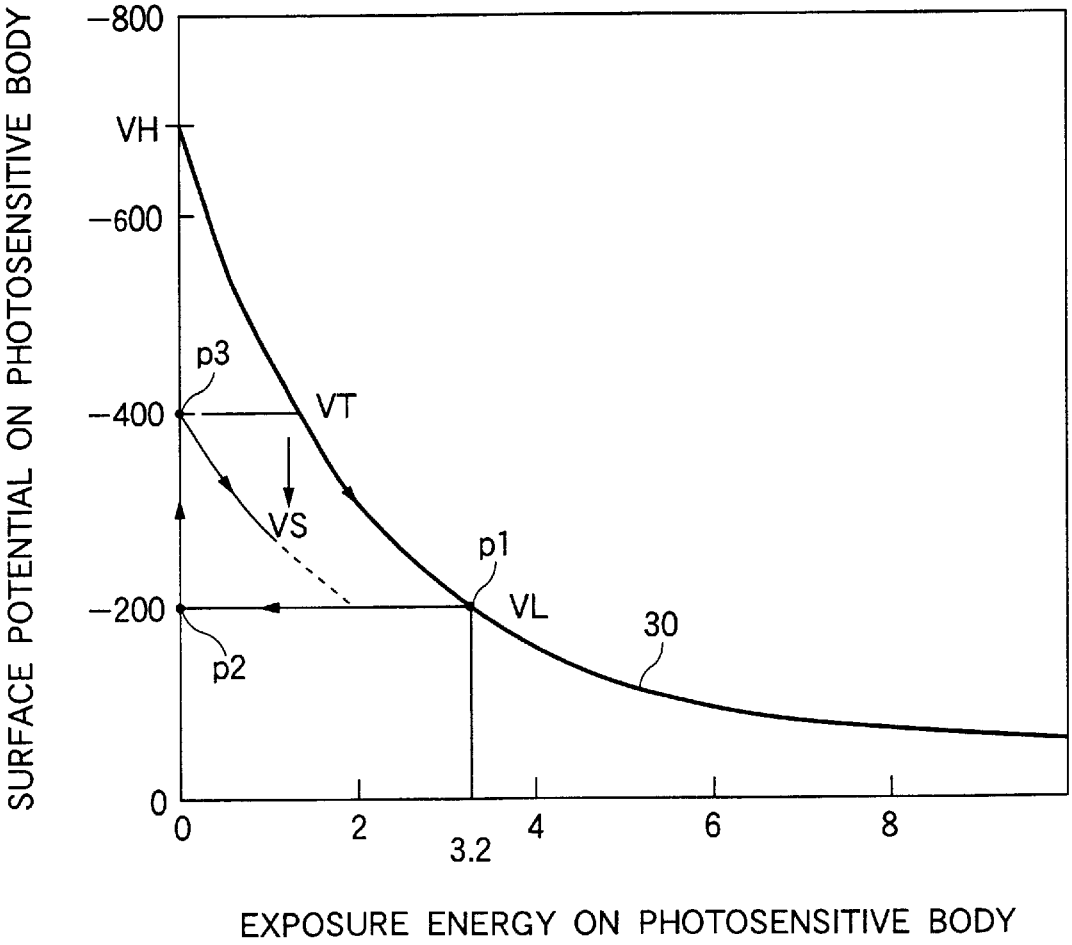
FIG. 12 is a graph to represent change in a surface potential.

FIG. 12 is a graph to represent change in the surface potential.

The graph shows the surface potential on the vertical axis and energy of exposure light (light amount) on the horizontal axis. When primary exposure light of 3.2 mJ/cm$^2$for example, is applied to the photosensitive body charged to the background potential VH, the photosensitive body is diselectrified along a curve 30 in the graph and reaches the primary exposure potential VL (point p1). If applying the primary exposure light stops, the photosensitive body maintains the primary exposure potential VL (point p2) and when toner is deposited, the photosensitive body becomes the toner image potential VT (point p3). After this, when secondary exposure light is applied, the photosensitive body is diselectrified so as to proceed in parallel with the curve 30 in the graph and reaches the secondary exposure potential VS responsive to the energy of the light passing through the toner patch image.

The difference between the toner image potential VT and the secondary exposure potential VS has correlation with the toner amount of the toner patch image and thus the toner image can be derived from the potential difference based on the correlation. The surface potential of the photosensitive body can be measured with a surface potential sensor, etc. If change in the toner image potential VT responsive to toner amount change can be ignored, the toner amount can also be derived based only on the secondary exposure potential VS. However, the change in the toner image potential VT responsive to toner amount change cannot generally be ignored and preferably the toner amount is derived based on the difference between the toner image potential VT and the secondary exposure potential VS. The description to follow assumes that the toner amount is derived based on the potential difference.

Figure 13:
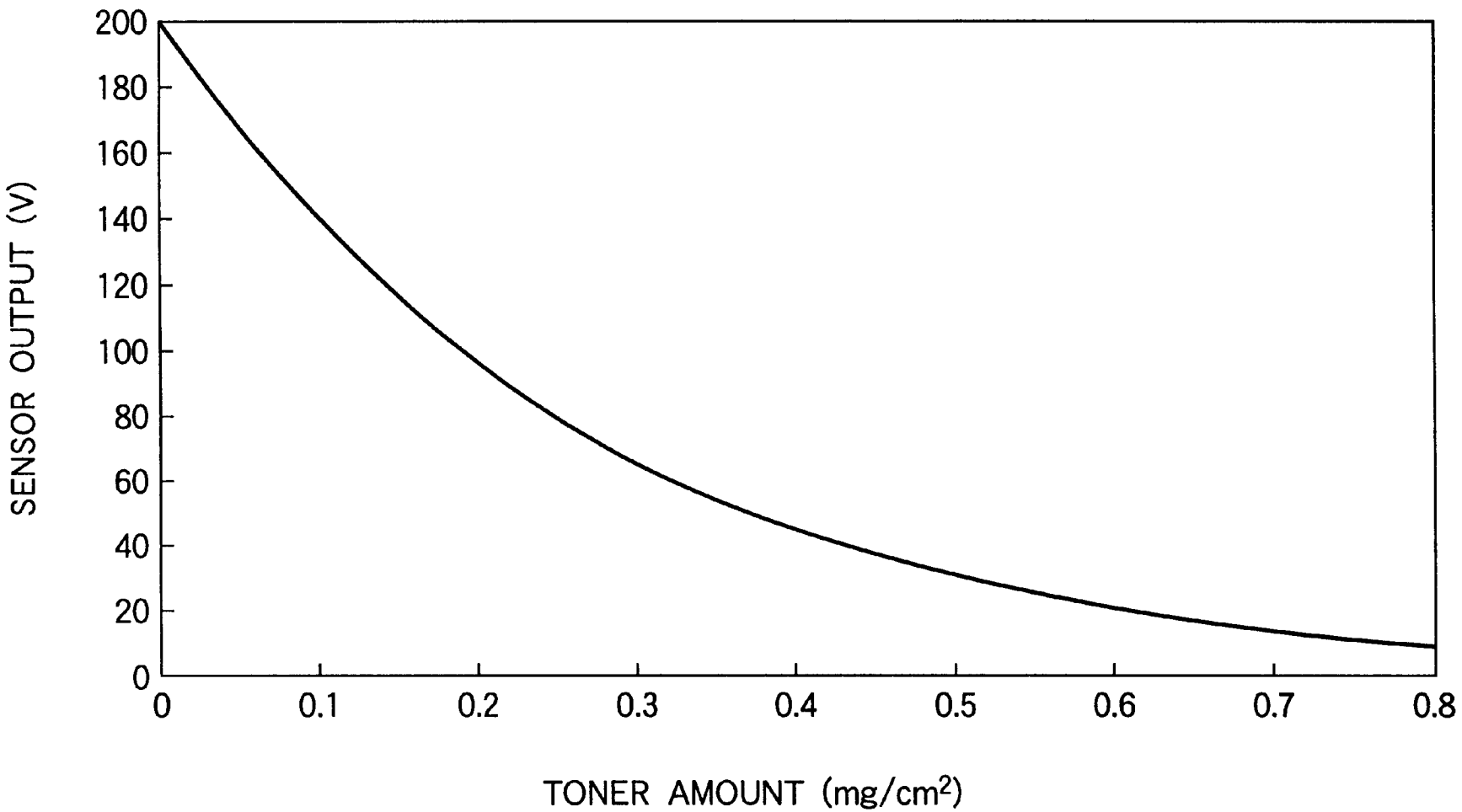
FIG. 13 is a graph to represent the sensitivity of toner amount measurement in the invention.

FIG. 13 is a graph to represent the sensitivity of toner amount measurement in the invention.

The graph shows on the vertical axis the difference between the toner image potential VT and the secondary exposure potential VS measured with a surface potential sensor and on the horizontal axis the toner amount of black toner. The inclination of the graph represents the measurement sensitivity.

Figure 14:
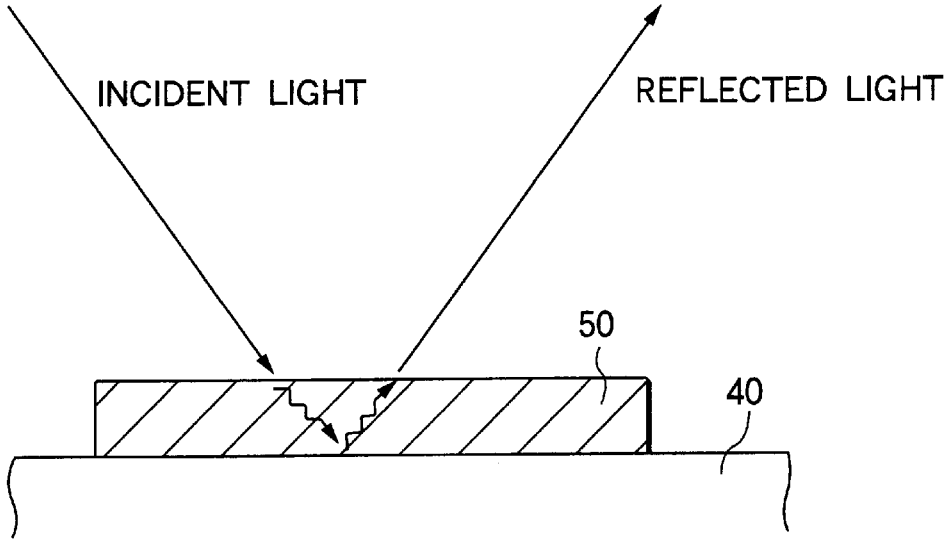
FIG. 14 is a drawing to show light contributing to toner amount measurement using specularly reflected light.
Figure 15:
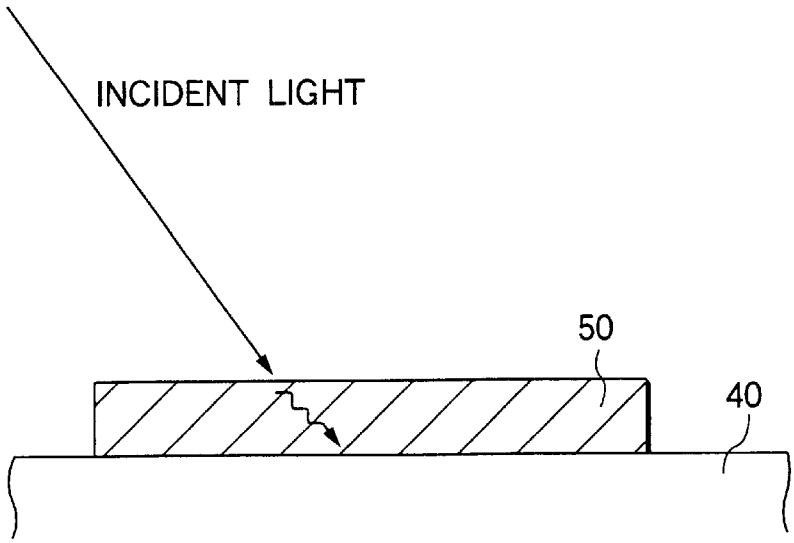
FIG. 15 is a drawing to show light contributing to toner amount measurement in the invention.

The inclination of the graph (namely, measurement sensitivity) is sufficiently large even in the range of high toner amounts exceeding 0.5 mg/cm2; in the invention, toner amount measurement can also be conducted in the range. Such a range of high toner amounts is an immeasurable range in the toner amount measurement method using specularly reflected light in the related art because output becomes saturated and the measurement sensitivity is small. Such a measurement sensitivity difference is based on the reason described below:

FIG. 14 is a drawing to show light contributing to toner amount measurement using specularly reflected light. FIG. 15 is a drawing to show light contributing to toner amount measurement in the invention.

In the toner amount measurement method using specularly reflected light, light is applied to a photosensitive body 40 on which toner is deposited from above a toner layer 50 and the light specularly reflected on the photosensitive body surface is received on the top of the toner layer, whereby the toner amount is measured. Thus, the light contributing to the toner amount measurement is specularly reflected light on the toner layer 50 and the ratio of the specularly reflected light amount to the incident light amount is equal to the square of the transmittance of the toner layer.

In contrast, in the toner amount measurement based on the surface potential in the invention, light is applied to a photosensitive body 40 on which toner is deposited from above a toner layer 50 and potential change caused by the light arriving at the photosensitive body is measured, whereby the toner amount is measured. Thus, the light contributing to the toner amount measurement is transmitted light passing through the toner layer 50 only once and the ratio of the transmitted light amount to the incident light amount is equal to the transmittance of the toner layer.

Figure 16:
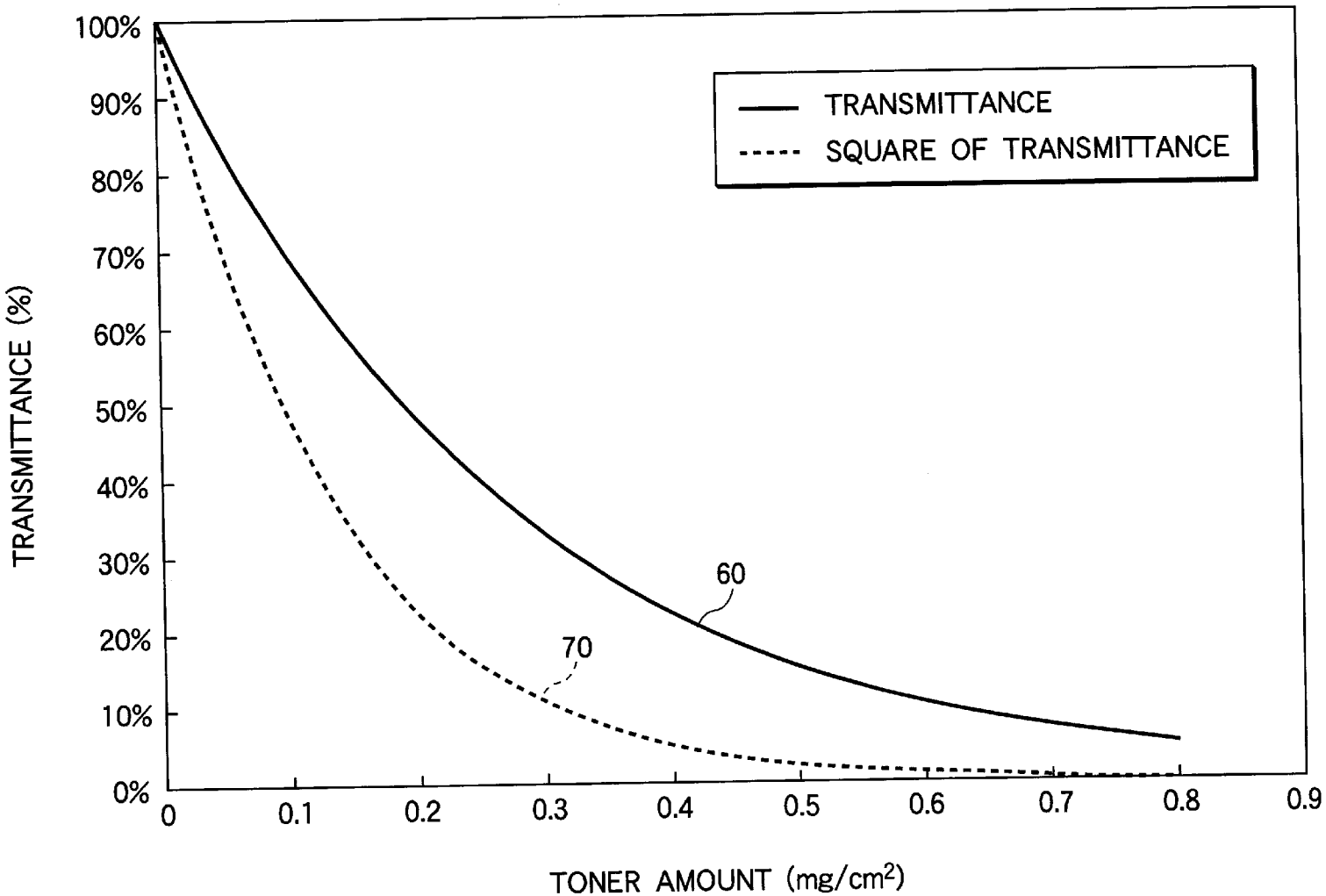
FIG. 16 is a graph to represent the sensitivity difference caused by the toner amount measurement method difference.

FIG. 16 is a graph to represent the measurement sensitivity difference caused by the toner amount measurement method difference.

The graph shows the toner amount on the horizontal axis. A solid line 60 represents the transmittance of the toner layer responsive to the toner amount and a dotted line 70 represents the square of the transmittance. In the toner amount measurement in the invention, the above-described transmittance contributes to the measurement and the ratio of the transmitted light amount to the incident light amount is equal to the transmittance of the toner layer and thus the amount of light contributing to the measurement decreases along the solid line 60 with an increase in the toner amount. The inclination of the solid line 60 also decreases with an increase in the toner amount, but is sufficiently large even when the toner amount exceeds 0.5 mg/cm$^2$; sufficient measurement sensitivity can be provided.

On the other hand, in the toner amount measurement using specularly reflected light, the specularly reflected light contributes to the measurement and the ratio of the specularly reflected light amount to the incident light amount is equal to the square of the transmittance of the toner layer and thus the amount of light contributing to the measurement decreases along the dotted line 70 with an increase in the toner amount. The inclination of the dotted line 70 decreases abruptly with an increase in the toner amount and becomes extremely small in the region wherein the toner amount exceeds 0.5 mg/cm$^2$; insufficient measurement sensitivity is provided.

According to the toner amount measurement in the invention, the toner amount can be measured for the toner image having a high toner amount on the photosensitive body based on the principle described above. Specific embodiments of the invention will be discussed.

First Embodiment

Figure 17:
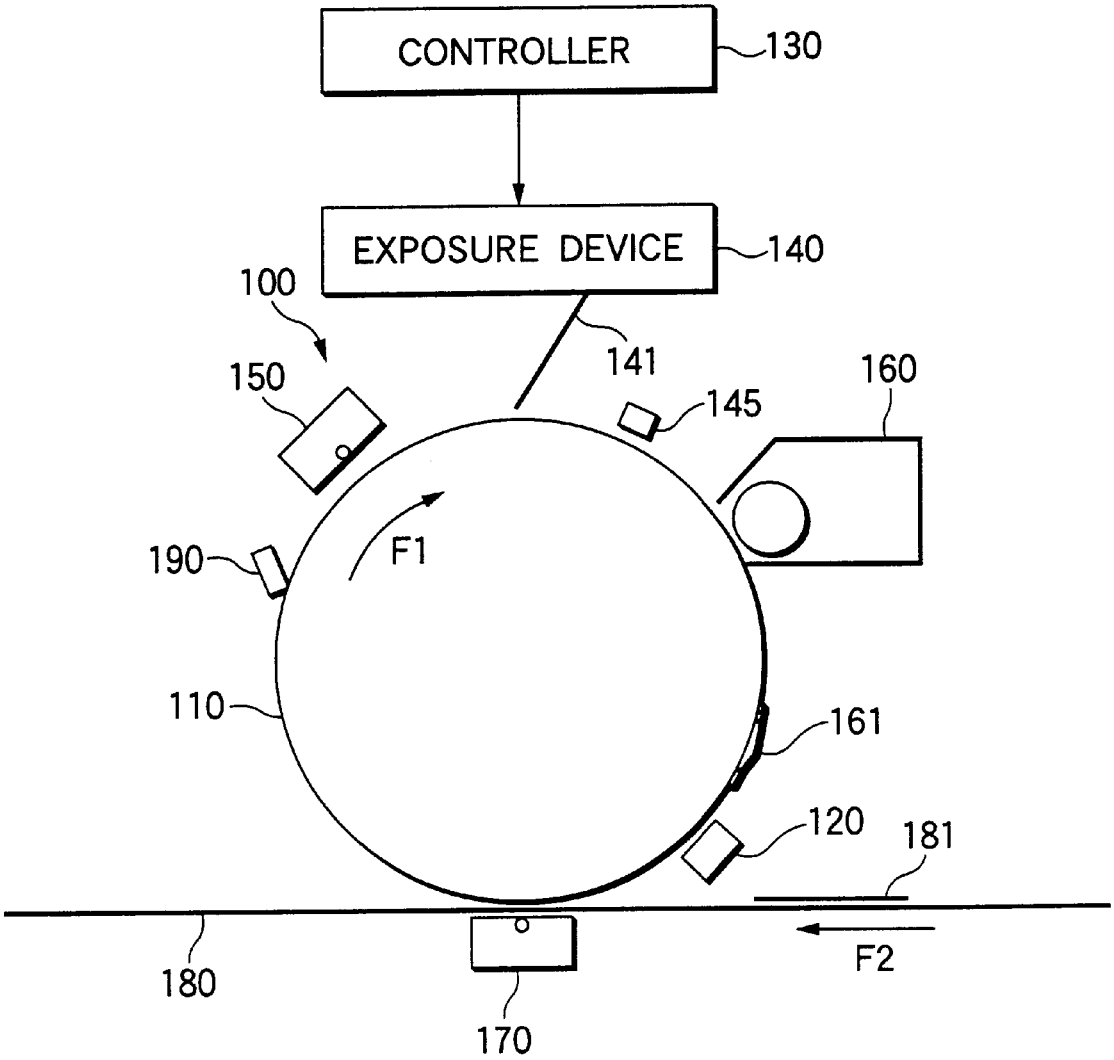
FIG. 17 is a drawing to show the configuration of a first embodiment of the invention.

FIG. 17 is a drawing to show the configuration of a first embodiment of the invention.

Figure 1:
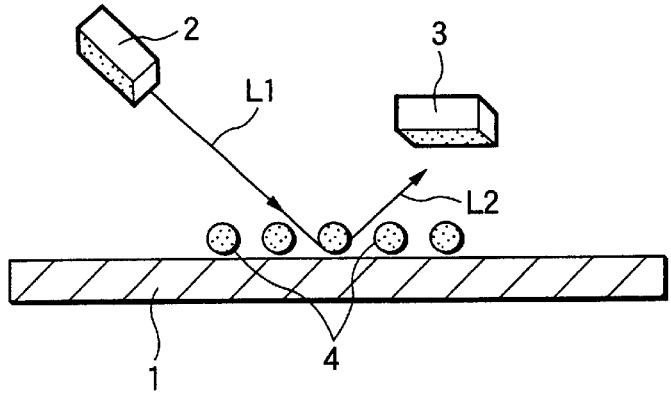
FIG. 1 is a drawing to show the measurement principle of a toner amount measurement method using specular reflection.
Figure 2:
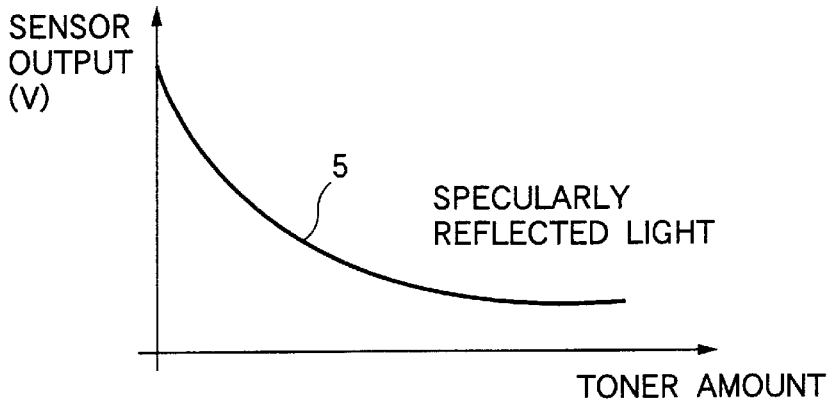
FIG. 2 is a graph to show the relationship between the toner deposition amount and the output voltage of a photosensor in the toner amount measurement method using specular reflection.
Figure 3:
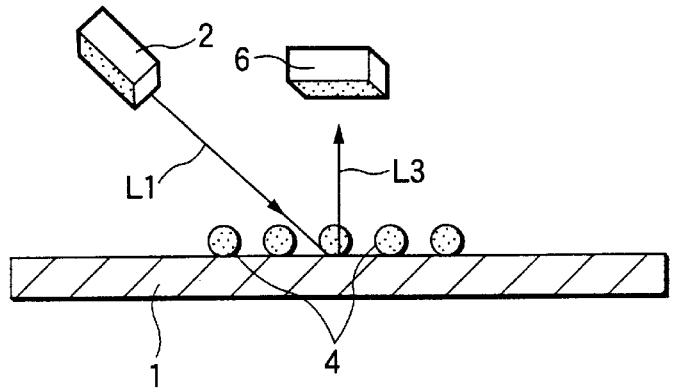
FIG. 3 is a drawing to show the measurement principle of a toner amount measurement method using scattered light.
Figure 4:
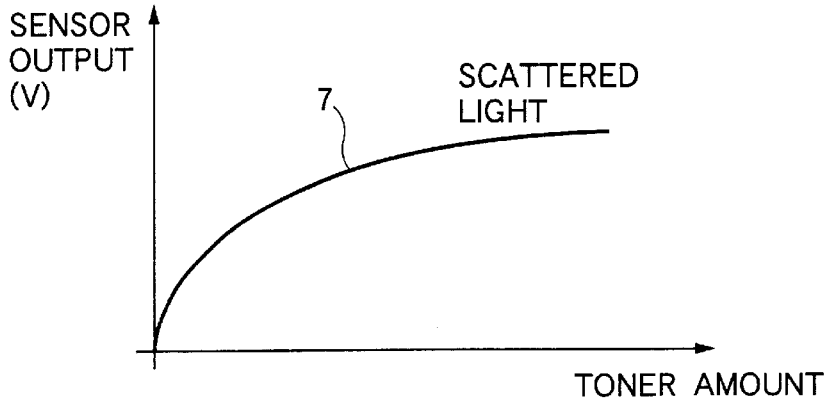
FIG. 4 is a graph to show the relationship between the toner deposition amount and the output voltage of a photosensor in the toner amount measurement method using scattered light.
Figure 5:
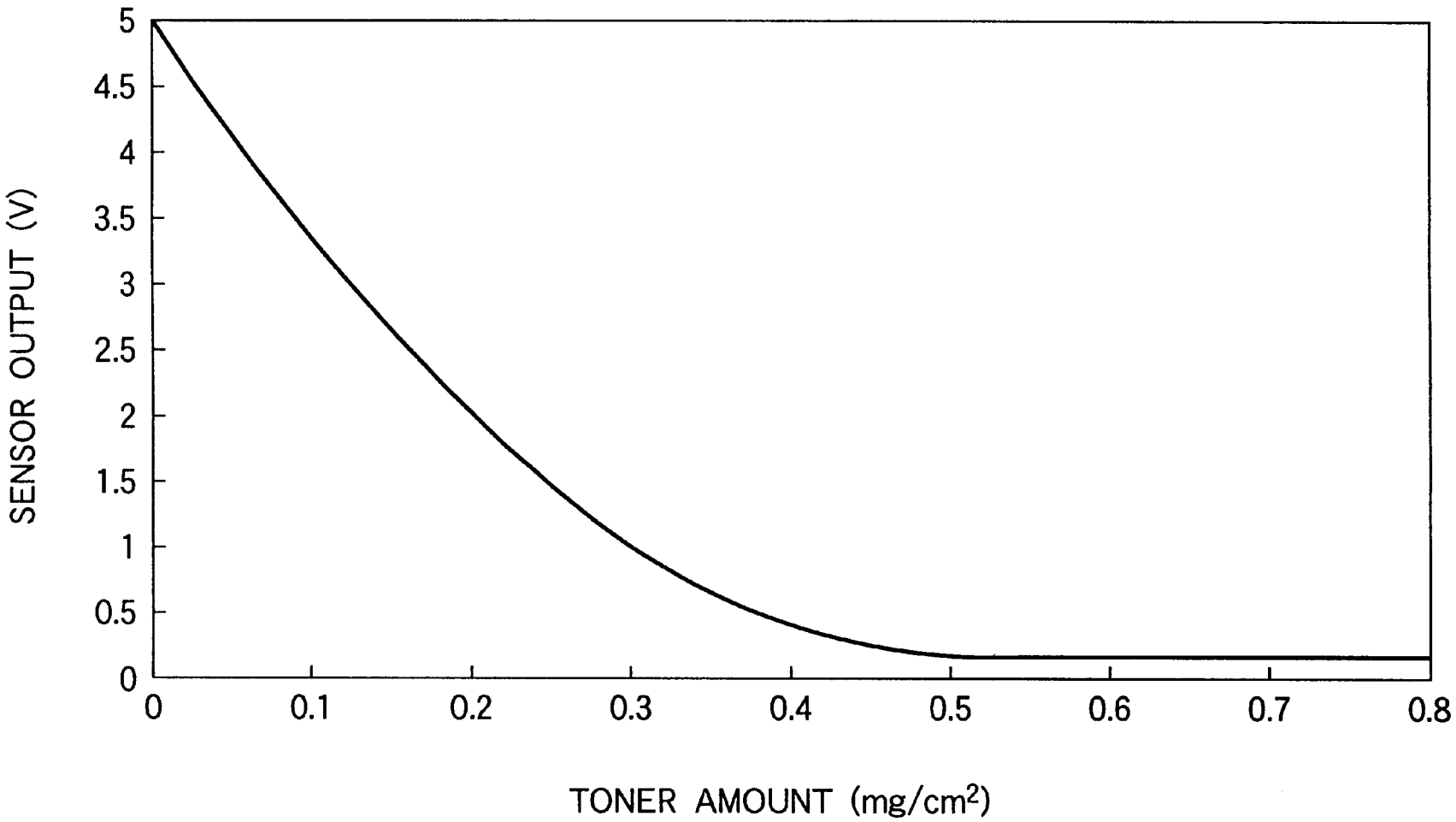
FIG. 5 is a graph to show the measurement sensitivity in the toner amount measurement method using specular reflections.
Figure 6:
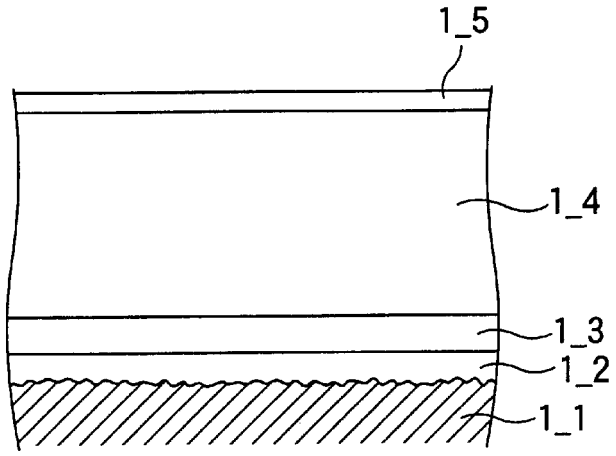
FIG. 6 is a drawing to show the structure of a surface of the type of photosensitive body currently mainstream.
Figure 7:
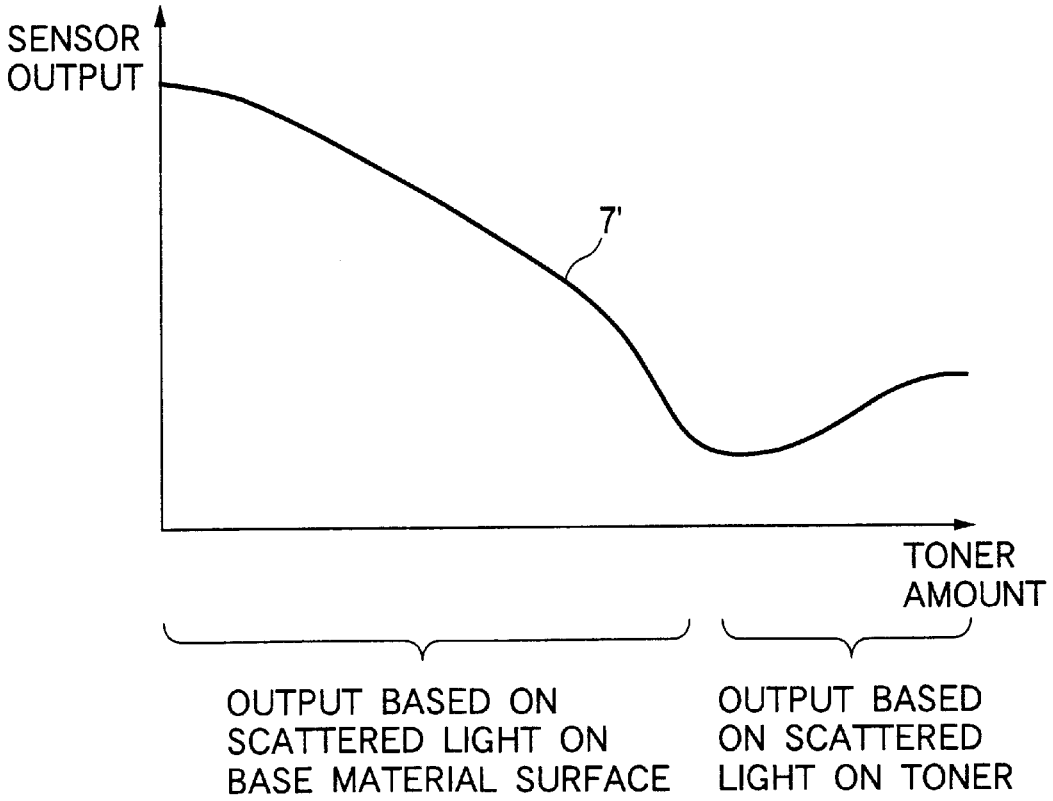
FIG. 7 is a graph to show the relationship between the toner deposition amount and the output voltage of a photosensor when the currently mainstream photosensitive body is used.

An image formation apparatus 100 finally forms a toner image on paper under an image formation condition that can be controlled. It comprises a photosensitive roll 110 covered on a peripheral surface with a photosensitive body mentioned in the invention, a laser exposure device 140, an example of a first light application section mentioned in the invention, a developing device 160, an example of a developing section mentioned in the invention, and a transfer device 170, an example of a transfer section mentioned in the invention. The image formation apparatus 100 also comprises a sensor unit 120 installing a second light application section and a potential measurement section mentioned in the invention and a controller 130 serving also as a toner amount derivation section and a condition control section. The photosensitive body covering the peripheral surface of the photosensitive roll 110 has the structure shown in FIG. 6. In the description that follows, the photosensitive roll 110 and the photosensitive body will not be distinguished from each other in some cases.

The photosensitive roll 110 rotates at a predetermined number of revolutions in the arrow F1 direction.

The controller 130 generates a laser on signal based on an image signal sent from a computer, etc., and outputs the laser on signal to the laser exposure device 140.

The laser exposure device 140 exposes the surface of the photosensitive roll 110 uniformly charged by a charger 150 to laser light 141 in accordance with the laser on signal sent from the controller 130, thereby changing the surface potential for forming an invisible electrostatic latent image on the surface of the photosensitive roll 110. Here, it is assumed that the surface of the photosensitive roll 110 is charged to −700 V by the charger 150 and is exposed with energy of 3.2 mJ/m$^2$ (light amount) by the laser exposure device 140 for forming a −200-V electrostatic latent image.

The surface potential of the photosensitive roll 110 on which the electrostatic latent image is formed is measured with a surface potential sensor 145 and is fed back into the controller 130.

The developing device 160 deposits toner selectively on the electrostatic latent image, thereby rendering the electrostatic latent image visible for forming a developed toner image 161.

The transfer device 170 transfers the developed toner image 161 on the photosensitive roll 110 to paper 181 transported in the arrow F2 direction on a transport belt 180 for forming a transferred toner image on the paper 181. The transferred toner image thus formed on the paper is fixed by a fuser (not shown) and the paper formed with the transferred toner image is transported to the outside of the printer 100. A section for transferring the developed toner image 161 onto the paper 181 through a plurality of steps via a transfer belt, etc., is also possible as the transfer section mentioned in the invention; here, the transfer device for transferring the developed toner image 161 directly onto the paper 181 is adopted.

A cleaner 190 removes toner not completely transferred to the paper by the transfer device 170 and remaining on the surface of the photosensitive roll 110.

The sensor unit 120 and the controller 130 measure the toner amount of the developed toner image 161 according to the above-described principle. The controller 130 controls the potential of the photosensitive roll 110, the power and output pattern of the laser exposure device 140, the developing voltage and toner amount of the developing device 160, the transfer voltage of the transfer device 170, etc., as required based on the measurement value of the toner amount.

The sensor 120 and its surroundings will be discussed in detail.

Figure 18:
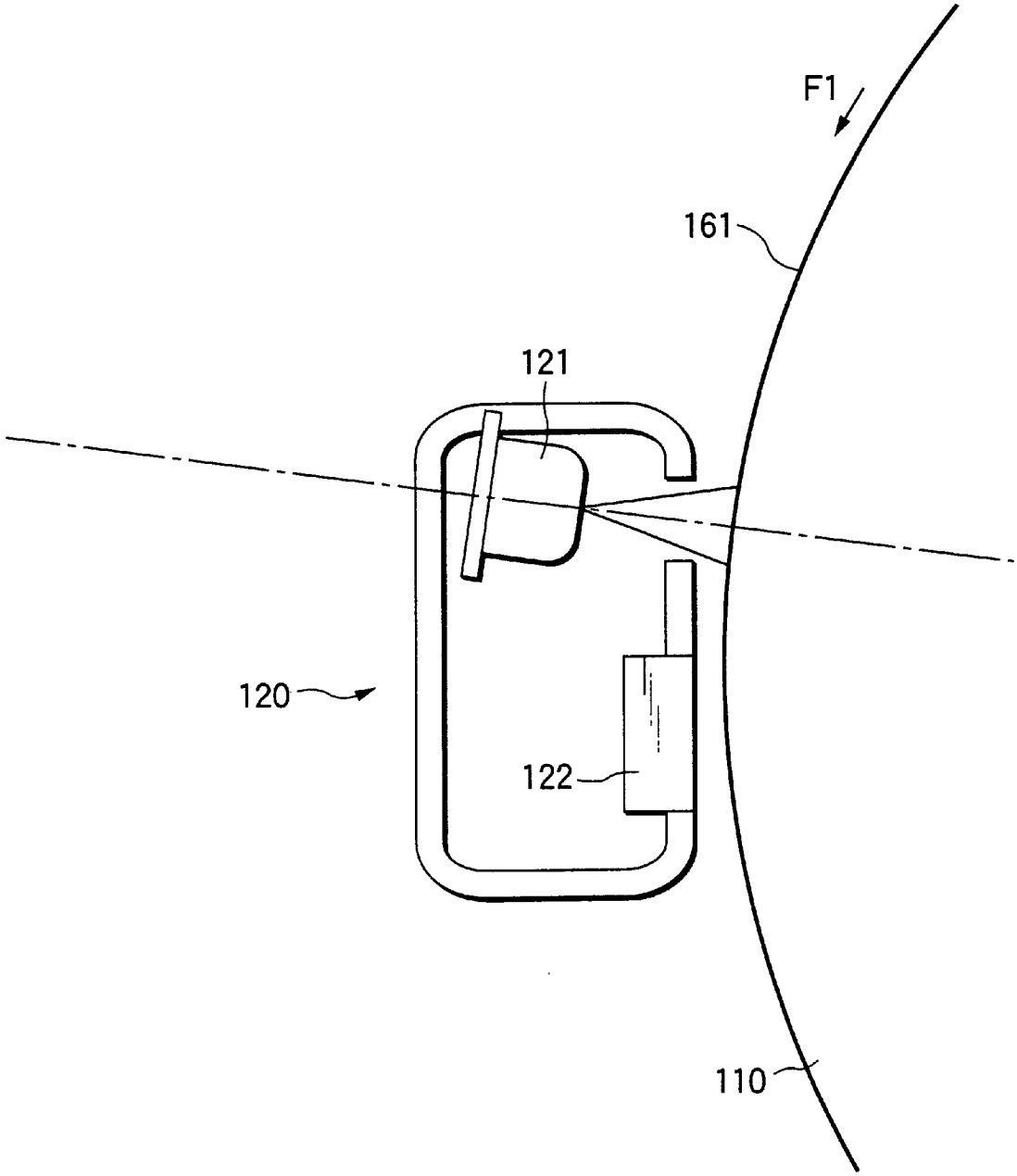
FIG. 18 is a drawing to show the configuration of a sensor unit in the first embodiment of the invention.

FIG. 18 is a drawing to show the configuration in the proximity of the sensor unit in the first embodiment of the invention.

As described above, the toner amount measurement principle of the invention is to apply light to the developed toner image 161 on the photosensitive roll 110 for changing the potential of the light application portion and deriving the toner amount from the potential change amount.

Installed in the sensor unit 120 are a laser diode 121, an example of the second light application section mentioned in the invention, and a surface potential sensor 122, an example of the potential measurement section mentioned in the invention. The laser diode 121 and the surface potential sensor 122 are placed side by side in the rotation direction of the photosensitive roll 110 indicated by the arrow F1.

Here, it is assumed that a patch image for control is generated as the developed toner image 161 on the photosensitive roll 110. The laser diode 121 emits light matching the timing at which the developed toner image (patch image) 161 moves with rotation of the photosensitive roll 110, and applies secondary exposure light to the secondary exposure area 20 shown in FIG. 8. The reason why the laser diode 121 is adopted as an example of the second light application section is that it is inexpensive and that generally a photodiode for monitoring the light amount is contained in a package and light amount management is easy to conduct. An LED, etc., is possible as another example of the second light application section; preferably a photodiode for monitoring the output light amount or the like is added.

The surface potential sensor 122 measures the surface of the photosensitive roll 110 outside and inside the secondary exposure area 20 to which the secondary exposure light is applied by the laser diode 121.

Here, the laser diode 121 emits secondary exposure light of energy (light amount) of 1.8 mJ/m$^2$ so as to make it possible to conduct toner amount measurement in all the toner amount area of 0 to 0.8 mg/cm$^2$. If the secondary exposure light of the energy is applied directly to the surface of the photosensitive roll 110, it does not cause light degradation of the photosensitive body; when it is directly applied, it causes a potential difference of about 200 V to occur inside and outside the secondary exposure area 20. The exposure amount of light to the photosensitive roll 110 and the potential difference inside and outside the secondary exposure area 20 have an almost linear relationship. If the transmittance of the developed toner image 161 is 50%, the secondary exposure light of the energy of 1.8 mJ/m$^2$ causes a potential difference of about 100 V to occur inside and outside the secondary exposure area 20; if the transmittance is 20%, the secondary exposure light causes a potential difference of about 40 V to occur.

The measurement data provided by the surface potential sensor 122 is sent to the controller 130 shown in FIG. 17 and the controller 130 finds a difference between the surface potentials measured inside and outside the secondary exposure area 20 by the surface potential sensor 122 and derives the toner amount based on the potential difference and the graph of FIG. 13.

Thus, in the first embodiment of the invention, toner amount measurement can be conducted in all the toner amount area of 0 to 0.8 mg/cm$^2$. In the embodiment, toner amount measurement during operation can be conducted, of course.

However, if large noise is carried on output of the surface potential sensor 122, it is considered that it may become difficult to conduct high-accuracy toner amount measurement. For example, in the graph of FIG. 13, the difference between the potential when the toner amount is 0.6 mg/cm$^2$ and the potential when the toner amount is 0.8 mg/cm$^2$ is 10 V and to conduct toner amount measurement with accuracy of 0.01 mg/cm$^2$, the surface potential needs to be measured in steps of 0.5 V. However, the possibility that electromagnetic noise of about 0.5 V may occur cannot be ignored, and sufficient noise countermeasures, etc., are required.

On the other hand, it is considered that the measurement sensitivity in a high toner amount are a is enhanced by increasing the energy (light amount) of secondary exposure light.

Figure 19:
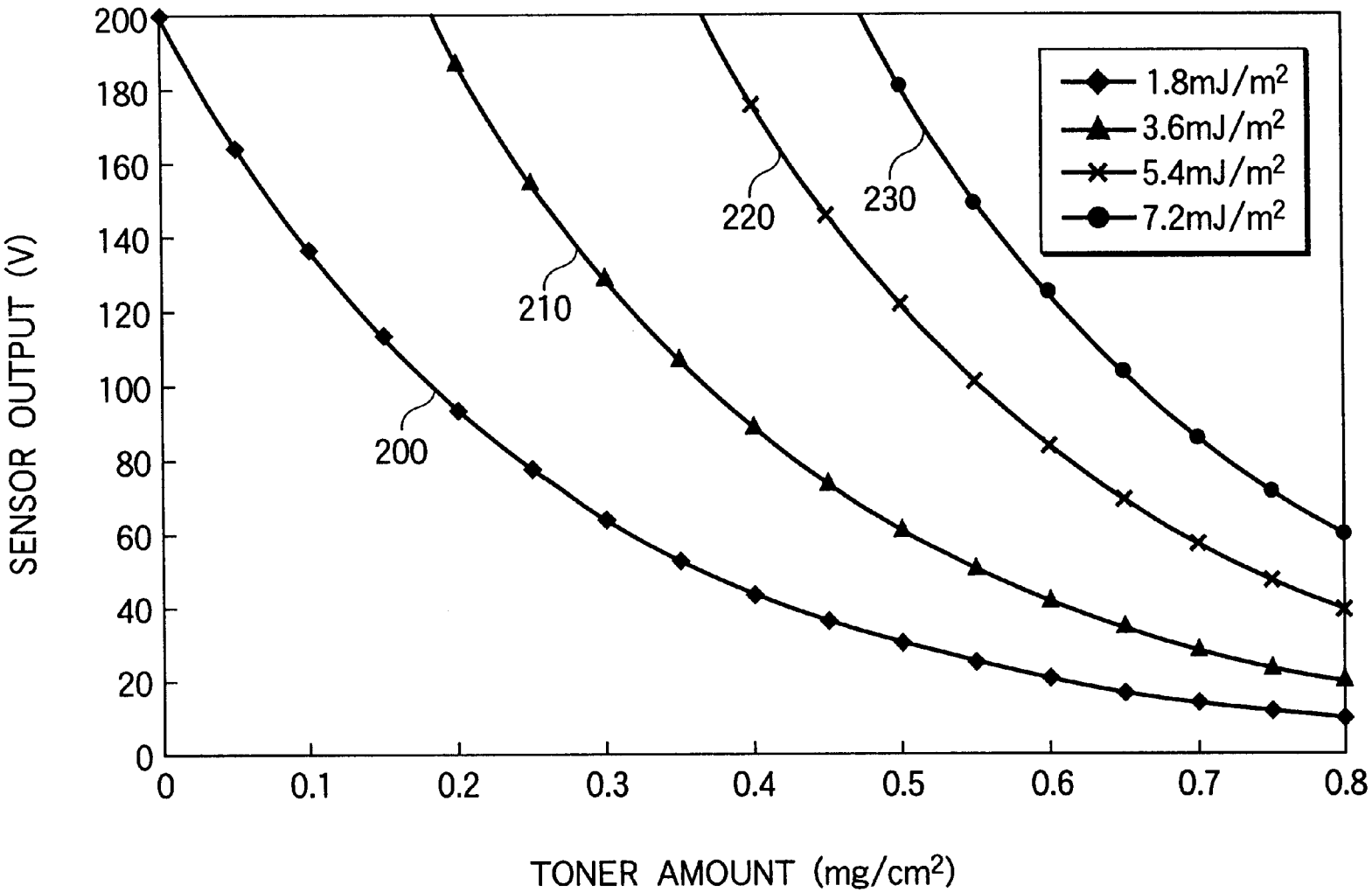
FIG. 19 is a graph to represent the relationship between the energy of secondary exposure light and measurement sensitivity.

FIG. 19 is a graph to represent the relationship between the energy of secondary exposure light and the measurement sensitivity.

A curve 200 with square marks shown in the graph of FIG. 19 is identical with the curve in the graph of FIG. 13 and represents the relationship between the toner amount and sensor output (potential difference) when the secondary exposure light of the energy of 1.8 mJ/m$^2$ is applied.

A curve 210 with triangular marks, a curve 220 with X marks, and a curve 230 with circle marks represent the relationship between the toner amount and sensor output (potential difference) when the energy of the secondary exposure light is enhanced twice the energy of 1.8 mJ/m$^2$, that when the energy is enhanced three times the energy of 1.8 mJ/m$^2$, and that when the energy is enhanced four times the energy of 1.8 mJ/m$^2$, respectively. The stronger the energy of the secondary exposure light, the larger the inclination of each curve; for example, if the area is exposed with energy of 5.4 mJ/m$^2$, the difference between the potential when the toner amount is 0.6 mg/cm$^2$ and the potential when the toner amount is 0.8 mg/cm$^2$ becomes 40 V. Thus, the potential resolution to measure the toner amount with the accuracy of 0.01 mg/cm$^2$ described above becomes 2 V and if noise is large, measurement can be conducted with good accuracy.

However, the secondary exposure light of the energy of 1.8 mJ/m$^2$ is selected considering the light-resistant strength of the photosensitive body and if the energy of the secondary exposure light is enhanced, light degradation of the photosensitive body in a low toner amount area introduces a problem. Therefore, it is desired that application of the secondary exposure light whose energy is enhanced should be limited to a reasonably high level of the toner amount range of the measurement object.

This means that it is desired that the balance of the light-resistant strength of the photosensitive body, the toner amount range of the measurement object, the measurement accuracy, etc., should be considered for selecting the energy of the secondary exposure light.

By the way, the applied light amount of the secondary exposure light can be adjusted by adjusting the drive electricity amount of the laser diode described above. Thus, an embodiment is possible wherein the application energy of the secondary exposure light is changed as required, whereby sufficient measurement accuracy and measurement sensitivity are provided while the photosensitive body is protected.

Second Embodiment

Figure 20:
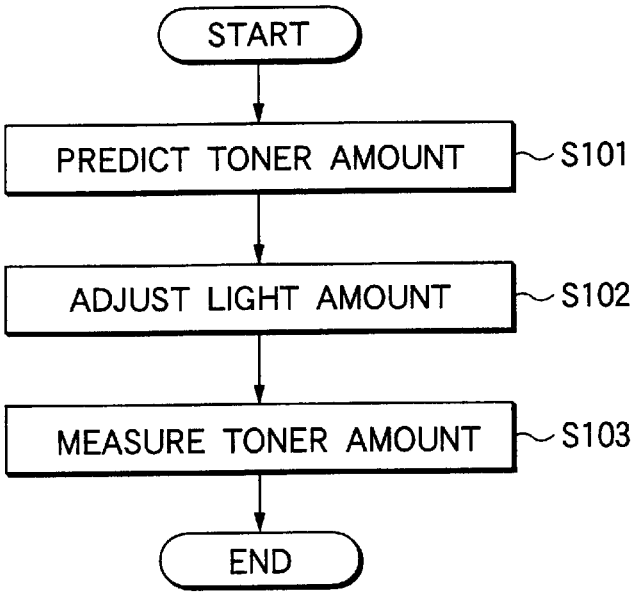
FIG. 20 is a flowchart to represent the operation of a second embodiment of the invention.

FIG. 20 is a flowchart to represent the operation of a second embodiment of the invention.

The configuration of the second embodiment is similar to that of the first embodiment except that a function as a light amount adjustment section mentioned in the invention is added to a controller.

In the second embodiment, the toner amount on a photosensitive body is predicted by the controller (step S101) and the applied light amount of a laser diode is adjusted to the light amount responsive to the predicted toner amount (step S102). The toner amount is predicted based on one or more of the output power of a laser exposure device, the toner supply amount to a developing device, the developing voltage of the developing device, the previous measurement value, and the like. If the predicted toner amount is a low toner amount, secondary exposure light is adjusted to low energy for circumventing light degradation of a photosensitive body. If the predicted toner amount is a high toner amount, the secondary exposure light is adjusted to high energy for enhancing the measurement sensitivity.

When such light amount adjustment terminates, toner amount measurement is conducted according to the above-described measurement method (step S103). In the toner amount measurement, the photosensitive body is protected from light degradation and sufficient measurement sensitivity is also provided.

Third Embodiment

Figure 21:
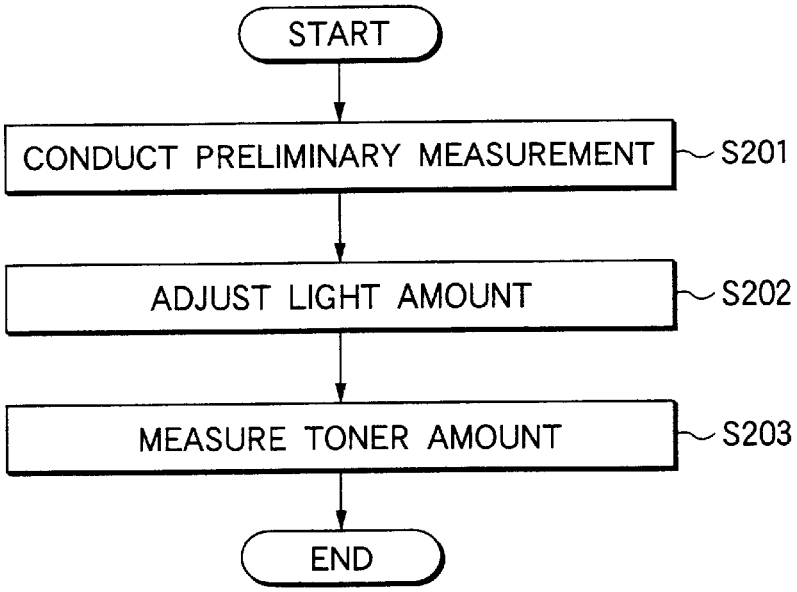
FIG. 21 is a flowchart to represent the operation of a third embodiment of the invention.

FIG. 21 is a flowchart to represent the operation of a third embodiment of the invention.

The configuration of the third embodiment is also similar to that of the first embodiment except that a function as a light amount adjustment section mentioned in the invention is added to a controller.

In the third embodiment, the applied light amount of a laser diode is adjusted to a predetermined light amount or less by the controller and preliminary measurement is conducted (step S201) and then the controller again adjusts the applied light amount of the laser diode to the light amount responsive to the toner amount derived by the preliminary measurement (step S202).

That is, exposure light is adjusted to such low energy avoiding light degradation of a photosensitive body at the preliminary measurement time and is adjusted to such energy providing sufficient measurement sensitivity at the re-adjustment time.

When the re-adjustment of the light amount (step 202) terminates, toner amount measurement is conducted according to the above-described measurement method (step S203). In the toner amount measurement, the photosensitive body is also protected from light degradation and sufficient measurement sensitivity is also provided.

The above-described embodiments can be applied intact to the image formation apparatus using black toner; however, to apply the embodiments to the image formation apparatus using color toner, the following points need to be considered:

Since black toner blocks light over every wavelength area of visible light, the transmittance and the toner amount have the almost linear relationship regardless of the wavelength of secondary exposure light. However, with color toner, there is wavelength dependency of the transmittance and thus the transmittance and the toner amount may have nonlinear relationship depending on the wavelength of secondary exposure light.

Figure 22:
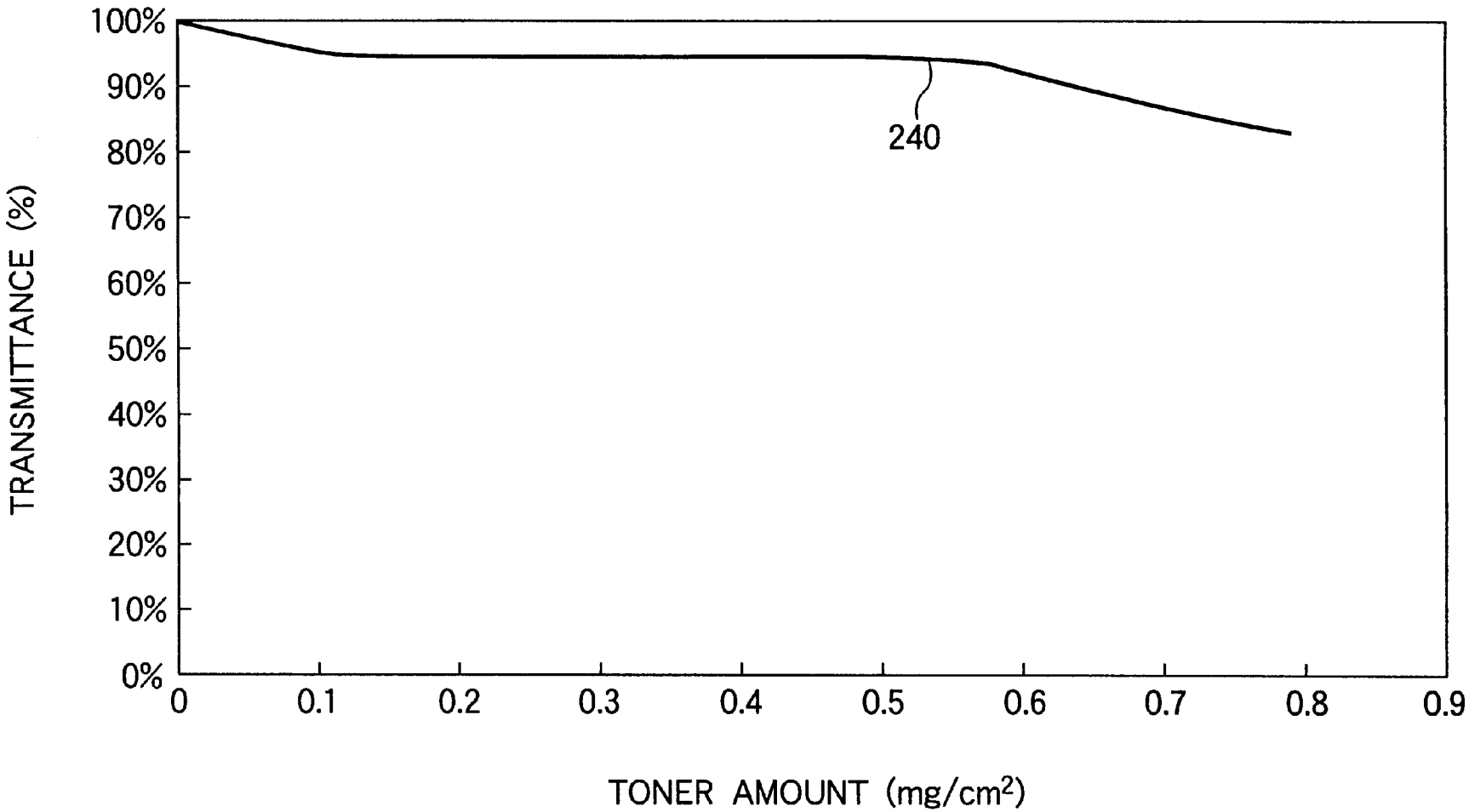
FIG. 22 is a graph to represent the transmittance of magenta toner.

FIG. 22 is a graph to represent the transmittance of magenta toner.

The graph shows the transmittance on the vertical axis and the toner amount on the horizontal axis and a curve 240 in the graph represents the relationship between the toner amount and the transmittance when HeNe laser light having a wavelength of 632.8 nm is applied to magenta toner.

For light having the wavelength 632.8 nm, the magenta toner allows most of incident light to pass through. Thus, if a considerably high toner amount area is reached, the transmittance scarcely lowers although it slightly lowers as the toner amount increases.

Figure 23:
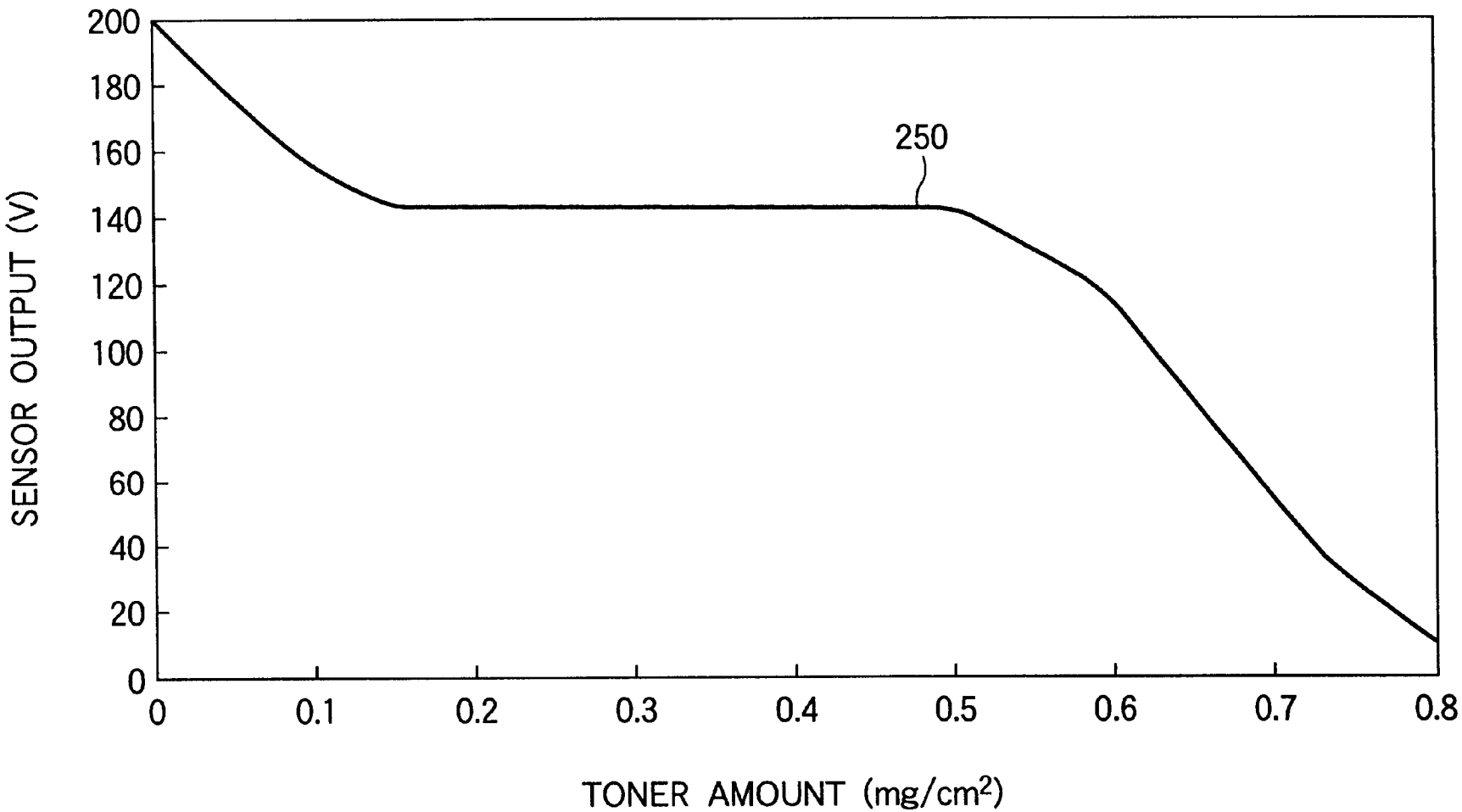
FIG. 23 is a graph to represent the measurement sensitivity when secondary exposure light having a wavelength of 632.8 nm is used for magenta toner.

FIG. 23 is a graph to represent the measurement sensitivity when the secondary exposure light having the wavelength 632.8 nm is used for the magenta toner.

The graph shows output of a surface potential sensor (potential difference) on the vertical axis and the toner amount on the horizontal axis. The inclination of a curve 250 in the graph represents the measurement sensitivity.

Here, the applied light amount is adjusted so that when the toner amount changes from 0 mg/cm$^2$ to 0.8 mg/cm$^{21}$ output changes about 200 V, and the measurement sensitivity is high in the high toner amount area exceeding 0.5 mg/cm$^2$. However, the inclination of the curve 250 is almost zero and the measurement sensitivity is also almost zero in the intermediate toner amount area ranging from 0.1 to 0.5 mg/cm$^2$. This means that the secondary exposure light having the wavelength 632.8 nm is not adequate to the toner amount measurement of the magenta toner.

Thus, the secondary exposure light of a wavelength with high transmittance out of the color toner absorption zone is not appropriate for the toner amount measurement.

Figure 24:
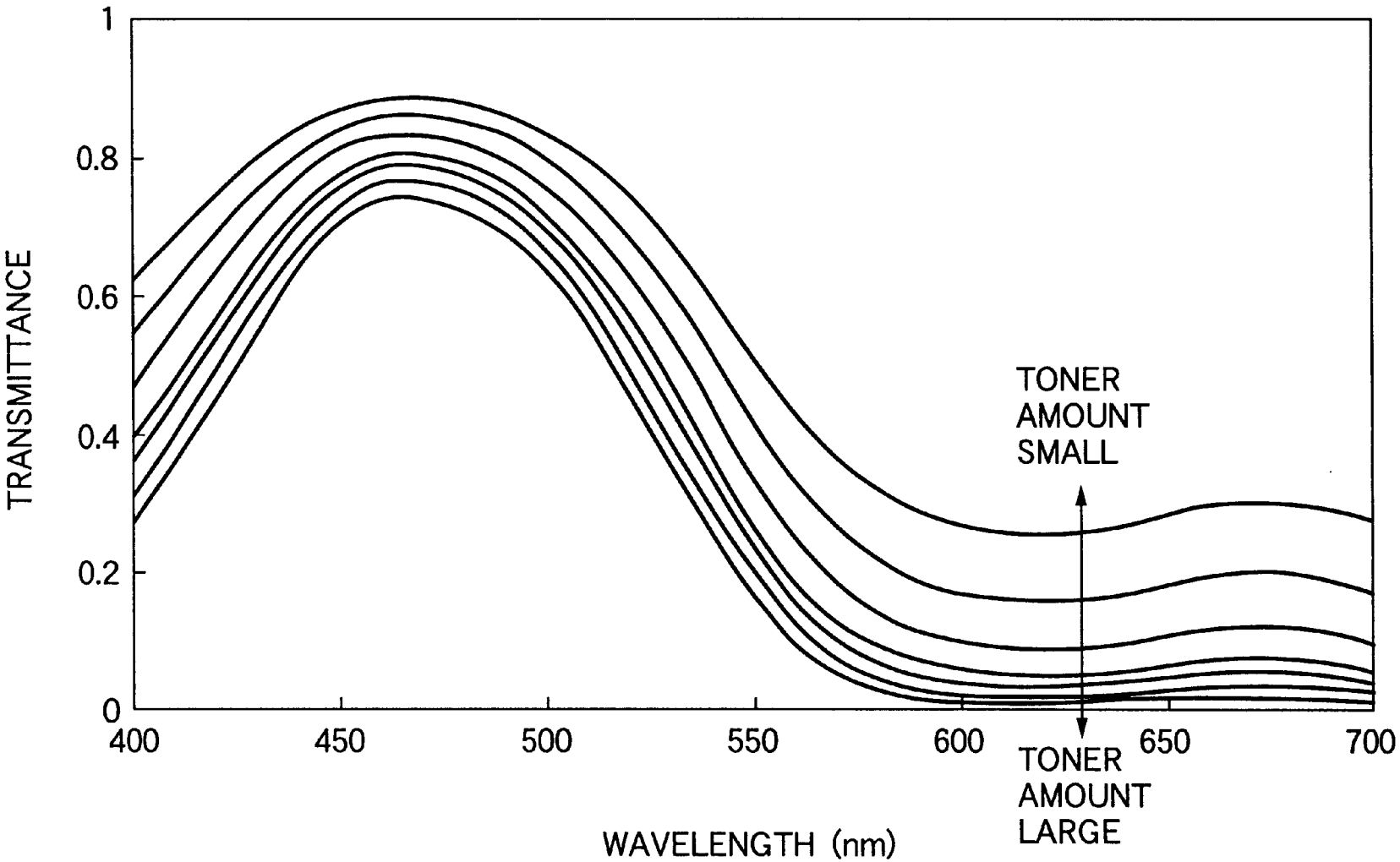
FIG. 24 is a graph to represent spectral transmittance of cyan toner.
Figure 25:
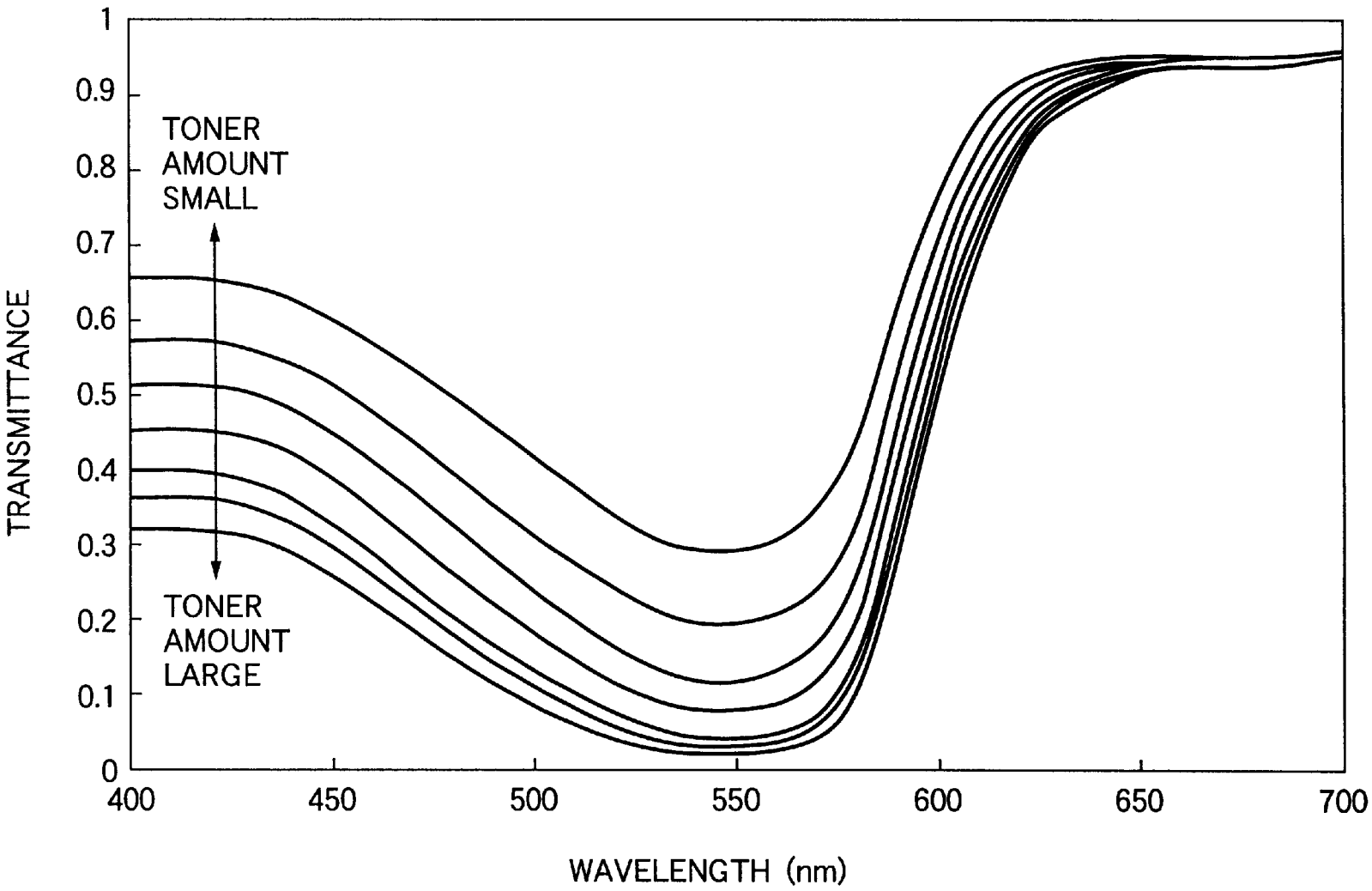
FIG. 25 is a graph to represent spectral transmittance of magenta toner.
Figure 26:
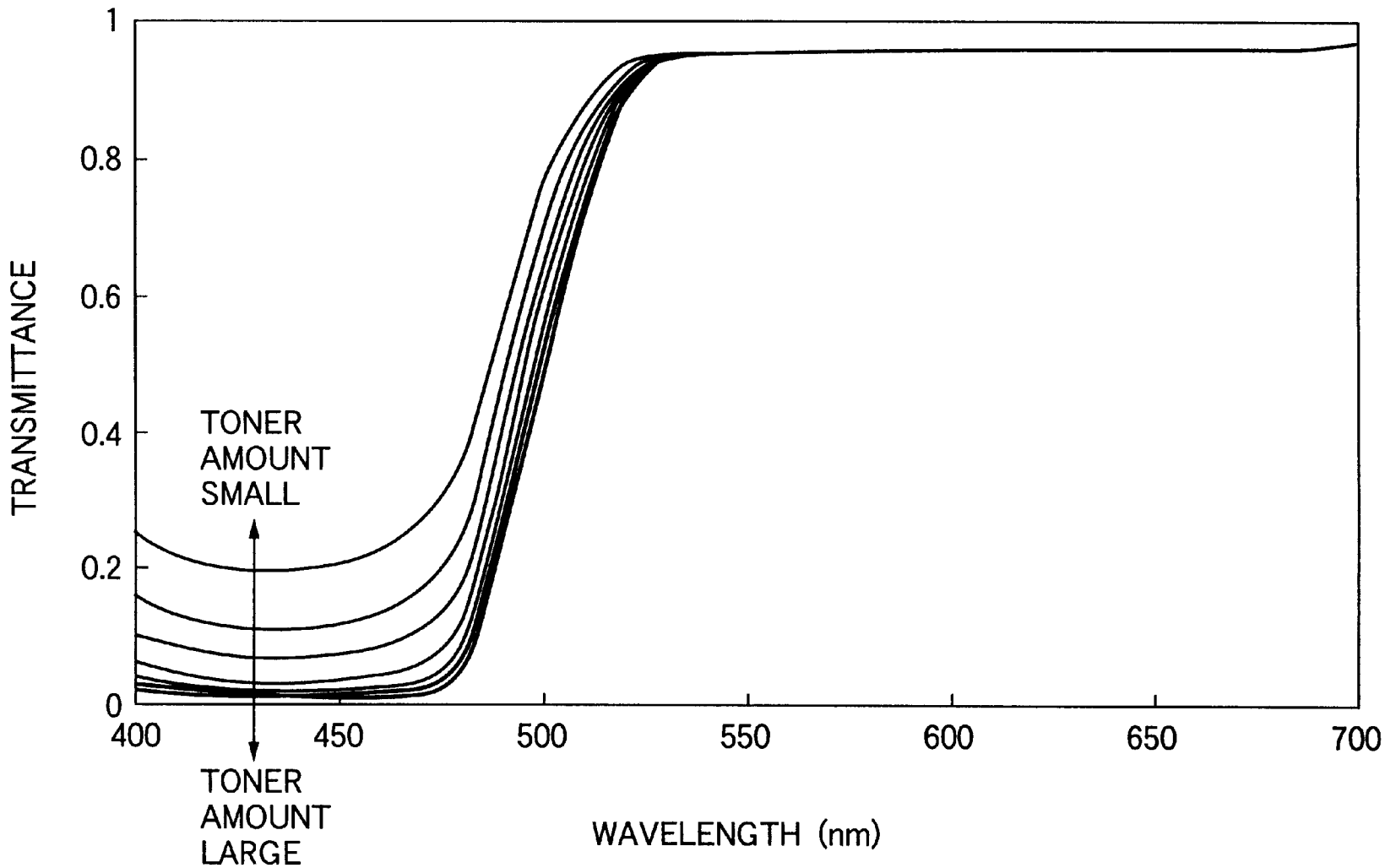
FIG. 26 is a graph to represent spectral transmittance of yellow toner.

FIG. 24 is a graph to represent spectral transmittance of cyan toner, FIG. 25 is a graph to represent spectral transmittance of magenta toner, and FIG. 26 is a graph to represent spectral transmittance of yellow toner.

Each graph represents the wavelength of light on the horizontal axis and the transmittance on the vertical axis and shows a plurality of curves to represent spectral transmittances in toner amounts.

As shown in the graph of FIG. 24, the cyan toner absorbs light to some extent in all the visible light wavelength area. If light having the wavelength 632.8 nm emitted from an HeNe laser or light in red to infrared regions emitted from a general laser diode is used as secondary exposure light, sufficient measurement sensitivity can be provided.

In contrast, the magenta toner and the yellow toner absorb light in the zone of 570 nm or less and in the zone of 500 nm or less, respectively, as shown in the graphs of FIGS. 25 and 26. Thus, measurement sensitivity is provided only when the secondary exposure light in the zone of 570 nm or less or that in the zone of 500 nm or less is used, and the HeNe laser light and the light emitted from a general laser diode are not proper as the secondary exposure light.

The laser diode for emitting light in red to infrared regions is easily available and at low costs, but is not fitted to toner amount measurement of magenta toner or yellow toner. Preferably, light emitted from a short-wavelength light source, such as a blue LED, is used for toner amount measurement of magenta toner and yellow toner. The blue LED, whose availability has been improved dramatically in recent years, emits light having a wavelength distribution with the center wavelength of about 430 nm. The light emitted from such a short-wavelength light source is light of wavelength in a zone absorbed by magenta toner and yellow toner; the light is applied as secondary exposure light, whereby sufficient measurement sensitivity can be provided.

If the developing device 160 shown in FIG. 17 develops an electrostatic latent image in a specific color toner, perferably a light source for emitting light having a wavelength responsive to the color toner is used as the second light application section mentioned in the invention.

Toner amount measurement using light with a plurality of wavelengths mixed as secondary exposure light is also possible.

Further, if different types of color toners are deposited on a photosensitive body, it is also possible to switch the wavelength of secondary exposure light to the wavelength responsive to the type of color toner deposited on the photosensitive body. An embodiment for thus switching the wavelength will be discussed.

Fourth Embodiment

Figure 27:
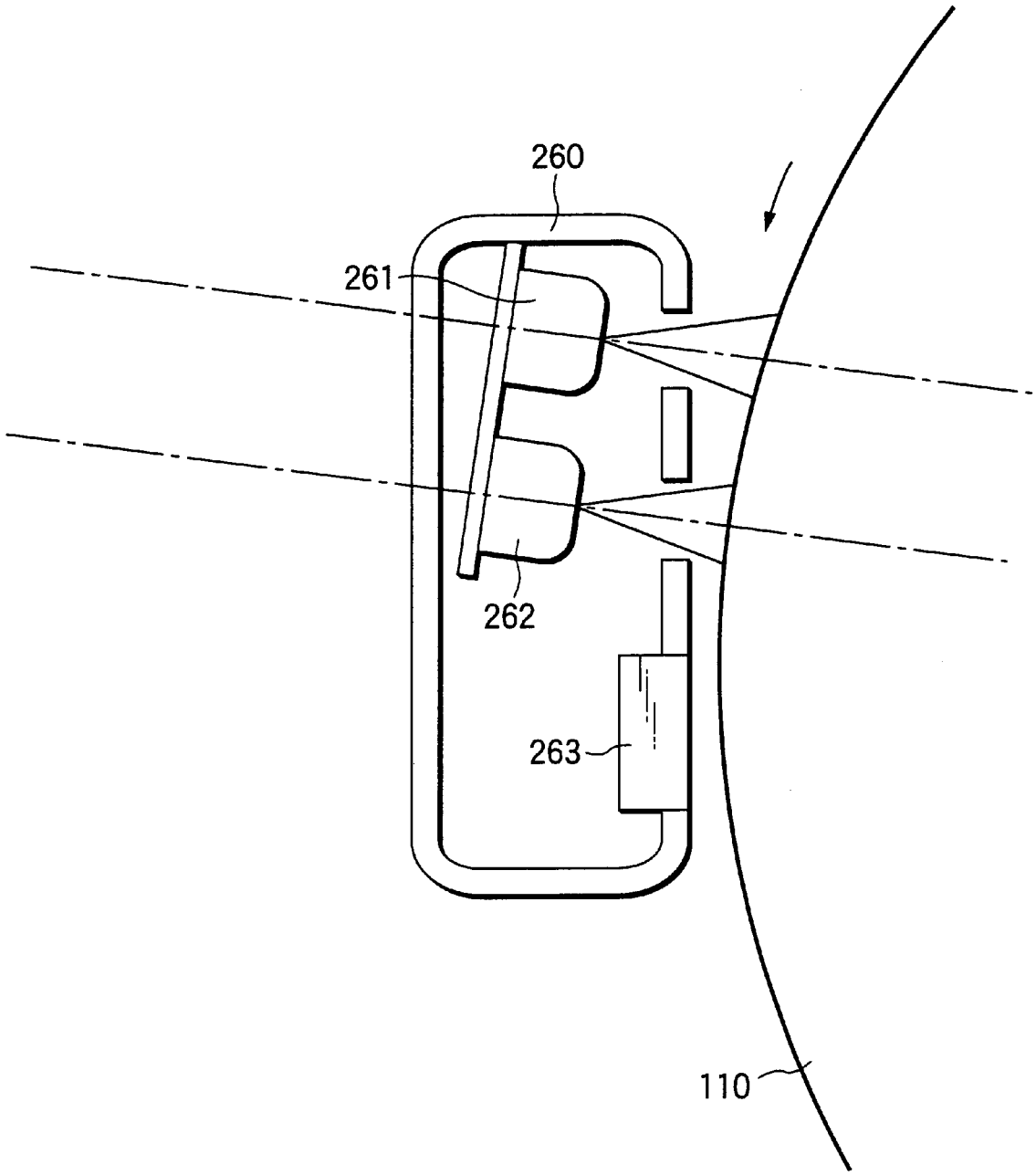
FIG. 27 is a drawing to show the configuration of a sensor unit in a fourth embodiment of the invention.
Figure 28:
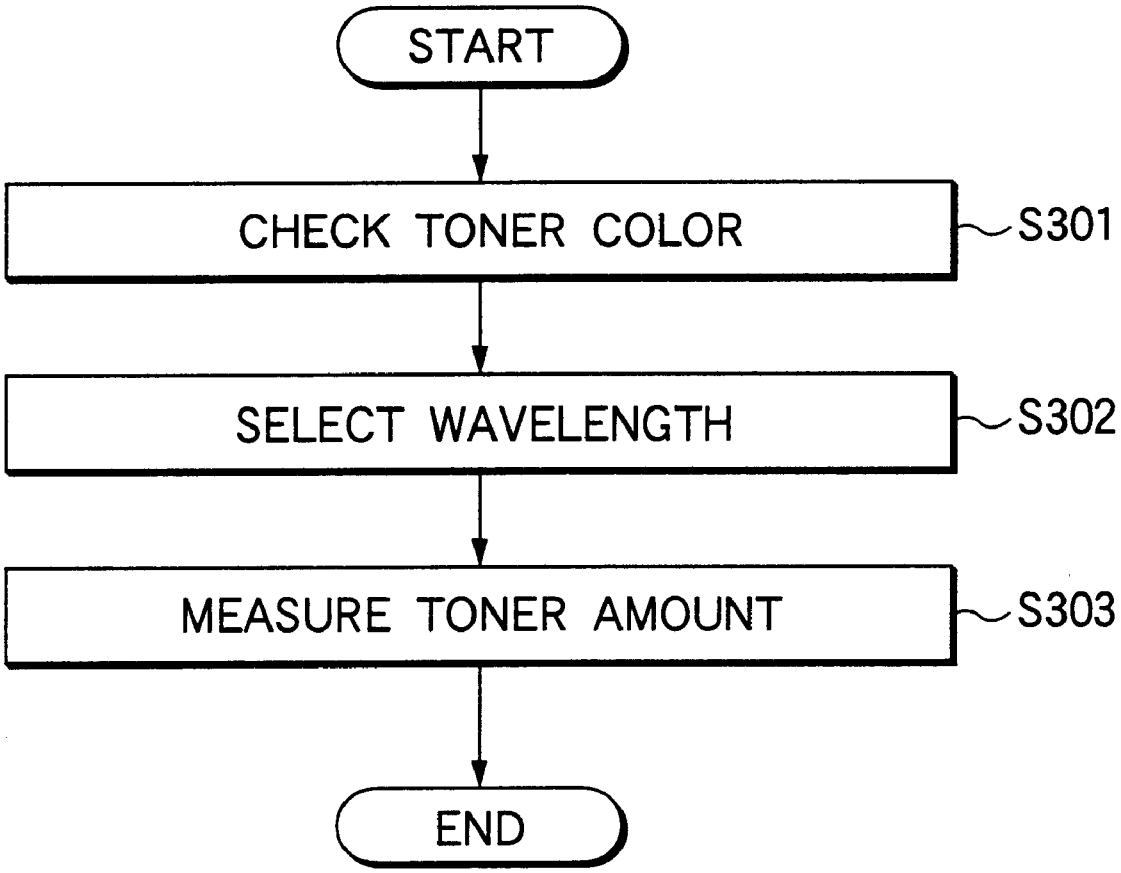
FIG. 28 is a flowchart to represent the operation of the fourth embodiment of the invention.

FIG. 27 is a drawing to show the configuration of a sensor unit in a fourth embodiment of the invention. FIG. 28 is a flowchart to represent the operation of the fourth embodiment of the invention.

The fourth embodiment is almost similar to the first embodiment except that a sensor unit 260 shown in FIG. 27 is provided in place of the sensor unit 120 shown in FIG. 18 and except that the developing device 160 shown in FIG. 17 can use different types of color toners properly.

The sensor unit 260 shown in FIG. 27 comprises a light source 261 for cyan toner and a light source 262 for yellow toner and magenta toner, and the light sources are disposed side by side in the rotation direction of a photosensitive roll 110. A signal indicating the type of color toner is input to the sensor unit 260 from a controller or the developing device (step S301 in FIG. 28), and the light source responsive to the signal is selected (step S302 in FIG. 28).

The sensor unit 260 also comprises a surface potential sensor 263 for measuring the surface potential of the photosensitive roll 110 to which secondary exposure light is applied by the two light sources 261 and 262, and the toner amount is measured based on the above-described principle (step S303 in FIG. 28).

The secondary exposure light of the wavelength responsive to each color toner is thus used, so that sufficient measurement sensitivity can be provided.

By the way, the sensitivity of the photosensitive body covering the surface of a photosensitive roll to light generally wavelength dependency.

Figure 29:
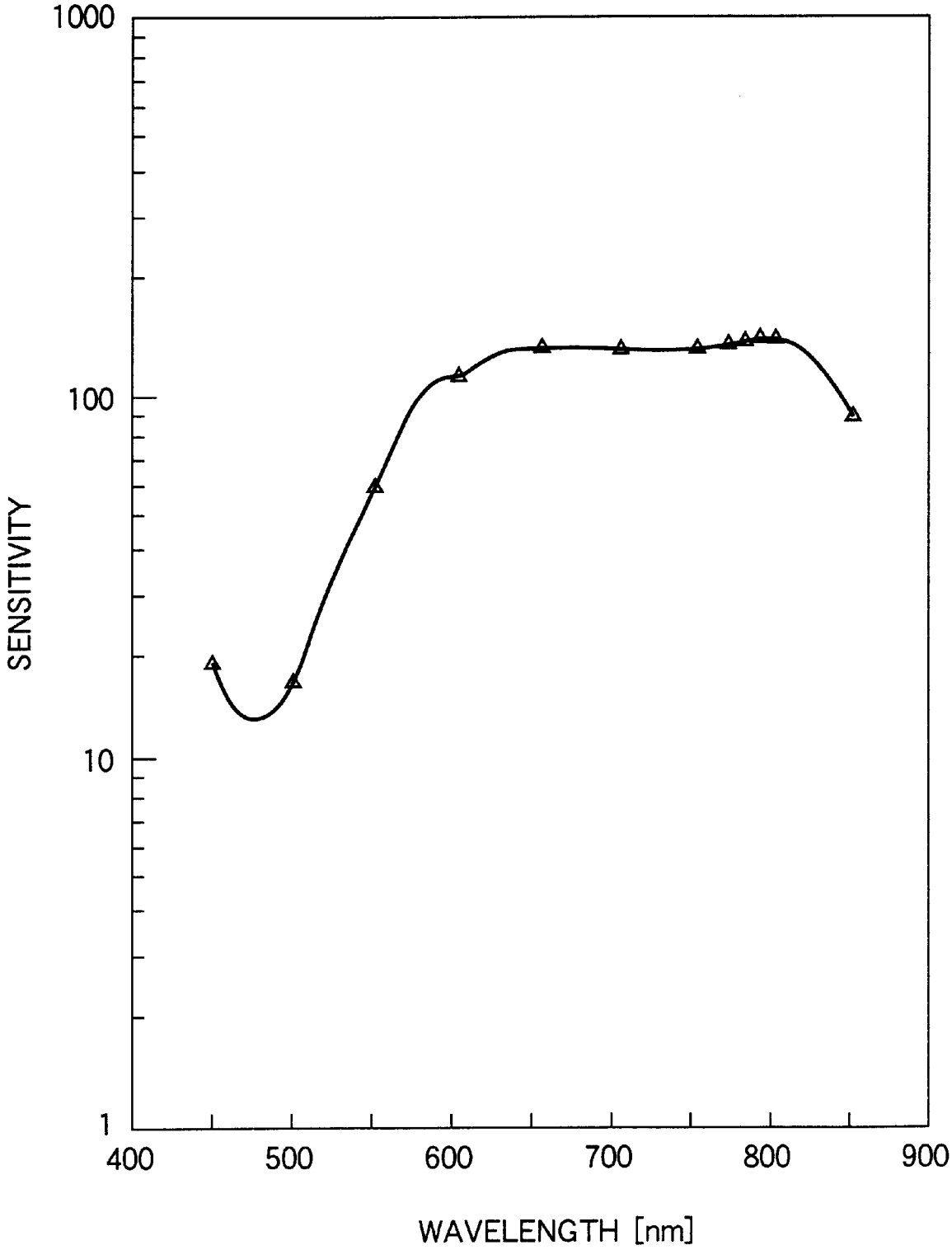
FIG. 29 is a graph to show an example of the spectral sensitivity of a photosensitive body.

FIG. 29 is a graph to show an example of the spectral sensitivity of a photosensitive body.

The graph shows the sensitivity of the photosensitive body to light on the vertical axis and the wavelength of light on the horizontal axis.

The graph shows the spectral sensitivity of the photosensitive body whose sensitivity to light in the wavelength of 500 nm or less is dropped extremely; as compared with the sensitivity to light in the proximity of 600 nm, the sensitivity to light in the wavelength area of 500 nm or less is lowered to about 1/10.

A photosensitive body having such spectral sensitivity may be used for a photosensitive roll, in which case if light of a blue LED having the center wavelength of 430 nm is applied to magenta toner or yellow toner on the photosensitive roll, a phenomenon in which the surface potential remains unchanged although the light transmittance in a high toner amount and that in a low toner amount differ occurs. If such a phenomenon occurs, it is made impossible to conduct toner amount measurement.

Then, a toner amount measurement method capable of measuring the toner amount of color toner if the photosensitive body indicating the spectral sensitivity as indicated by the graph of FIG. 29 is used for the photosensitive roll is proposed as described below:

The toner amount measurement method proposed here is characterized by the fact that secondary exposure light is applied to the surface of the photosensitive roll from a direction crossing the surface of the photosensitive roll at a Brewster angle.

Figure 30:
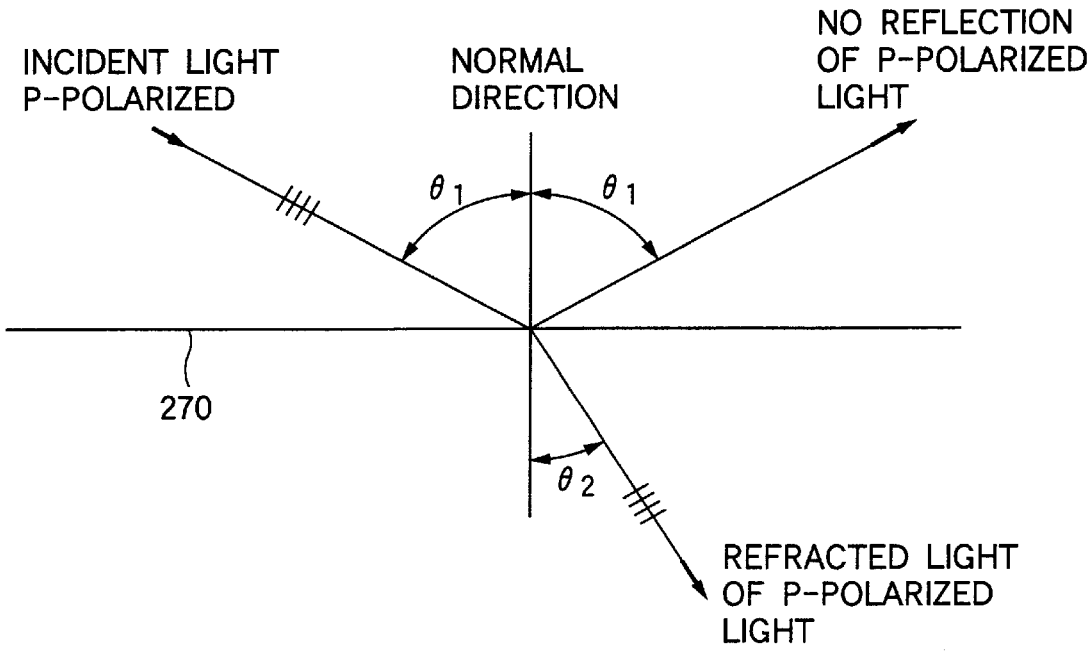
FIG. 30 is a schematic representation of a Brewster angle.

FIG. 30 is a schematic representation of the Brewster angle.

Media different in refractive index touch with an interface 270 between. If incident light is incident on the interface 270 at an incident angle θ1 from the medium having a relatively small refractive index (the upper medium in the figure), light refractedon the interface 270 enters the medium having a relatively large refractive index and proceeds in a refractive angle θ2 direction. Light reflected on the interface 270 proceeds in the same reflection angle θ1 direction as the incident angle θ1.

If incident light of p-polarization is incident on the interface 270 at a Brewster angle θp responsive to the refractive indexes of the media, no light is reflected and incident light becomes 100% refracted light, as known.

Figure 31:
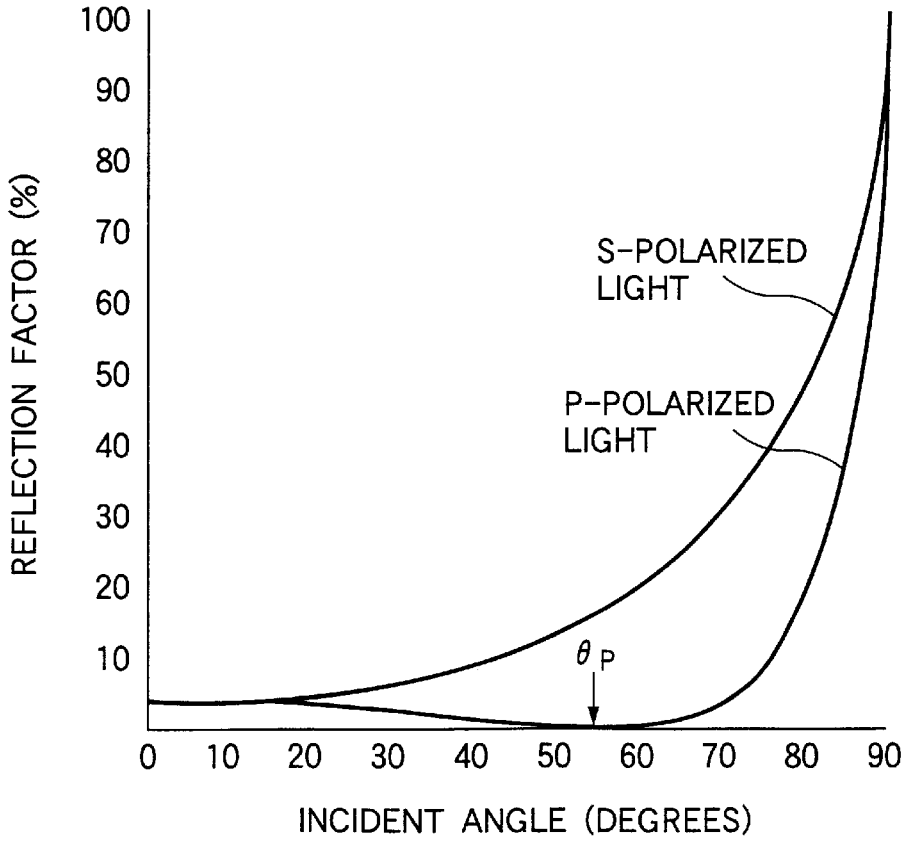
FIG. 31 is a graph to show incident angle dependency of reflection factor.

FIG. 31 is a graph to show incident angle dependency of reflection factor.

The graph shows the reflection factor on the interface 270 shown in FIG. 30 on the vertical axis and the incident angle on the horizontal axis.

At incident angle 0°, p-polarized light and s-polarized light do not distinguish and thus become the same reflection factor. At incident angle 90°, each light becomes 100% reflection factor.

The reflection factor of incident light of s-polarization increases monotonously from the incident angle 0° to the incident angle 90°. In contrast, the reflection factor of incident light of p-polarization decreases gradually as the incident angle grows from the incident angle 0°, and becomes 0% at the above-mentioned Brewster angle θp. Then, as the incident angle further grows, the reflection factor rapidly approaches 100%. Thus, the incident light of p-polarization and the incident light of s-polarization differ in incident angle dependency of reflection factor, and the difference between the reflection factor of the incident light of p-polarization and the reflection factor of the incident light of s-polarization reaches the maximum in the proximity of the Brewster angle.

By the way, if light uniform in polarization state is introduced into color toner, it is irregularly reflected in the color toner and the polarization state is lost, resulting in light with various polarization states mixed, as known.

Then, if light of p-polarization is used as secondary exposure light and is applied to the surface of a photosensitive roll from an angle in the proximity of the Brewster angle, almost all the secondary exposure light enters the photosensitive body covering the surface of the photosensitive roll in the absence of toner. On the other hand, in a state in which toner is deposited on the surface of the photosensitive body, the polarization state is lost and scattered light with p-polarized light and s-polarized light mixed occurs and is reflected on the surface of the photosensitive roll. Thus, as the larger the amount of toner deposited on the photosensitive roll, the less the light incident on the photosensitive body.

Fifth Embodiment

Figure 32:
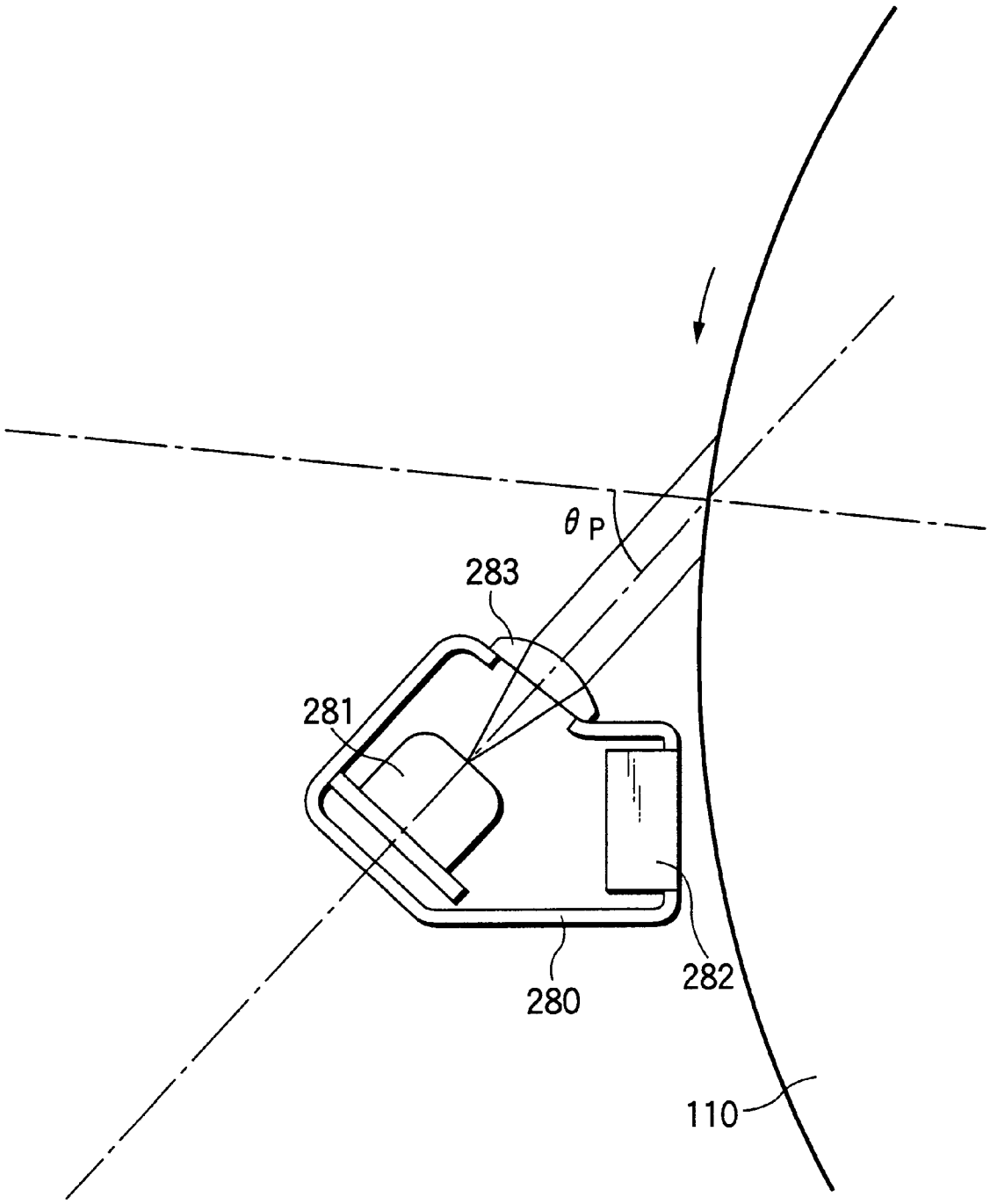
FIG. 32 is a drawing to show the configuration of a sensor unit in a fifth embodiment of the invention.

FIG. 32 is a drawing to show the configuration of a sensor unit in a fifth embodiment of the invention.

The fifth embodiment is almost similar to the first embodiment except that a sensor unit 280 shown in FIG. 32 is provided in place of the sensor unit 120 shown in FIG. 18.

The sensor unit 280 shown in FIG. 32 comprises a laser diode 281 for emitting secondary exposure light and a surface potential sensor 282 for measuring the surface potential of a photosensitive roll 110. The laser diode 281 emits light of p-polarization and applies secondary exposure light of a collimated light flux to the surface of the photosensitive roll 110. The secondary exposure light is applied to the surface of the photosensitive roll 110 from a direction crossing at Brewster angle θp. The Brewster angle θp is an angle responsive to the refractive index of the photosensitive body covering the surface of the photosensitive roll 110; the Brewster angle θp when the refractive index of a protective coat layer of the photosensitive body is n=1.585 is 57.8 degrees.

In the embodiment, the laser diode 281 is used, but an LED may be used as a light source, in which case polarized light is made uniform as p-polarized light by a polarization splitter, etc.

Figure 33:
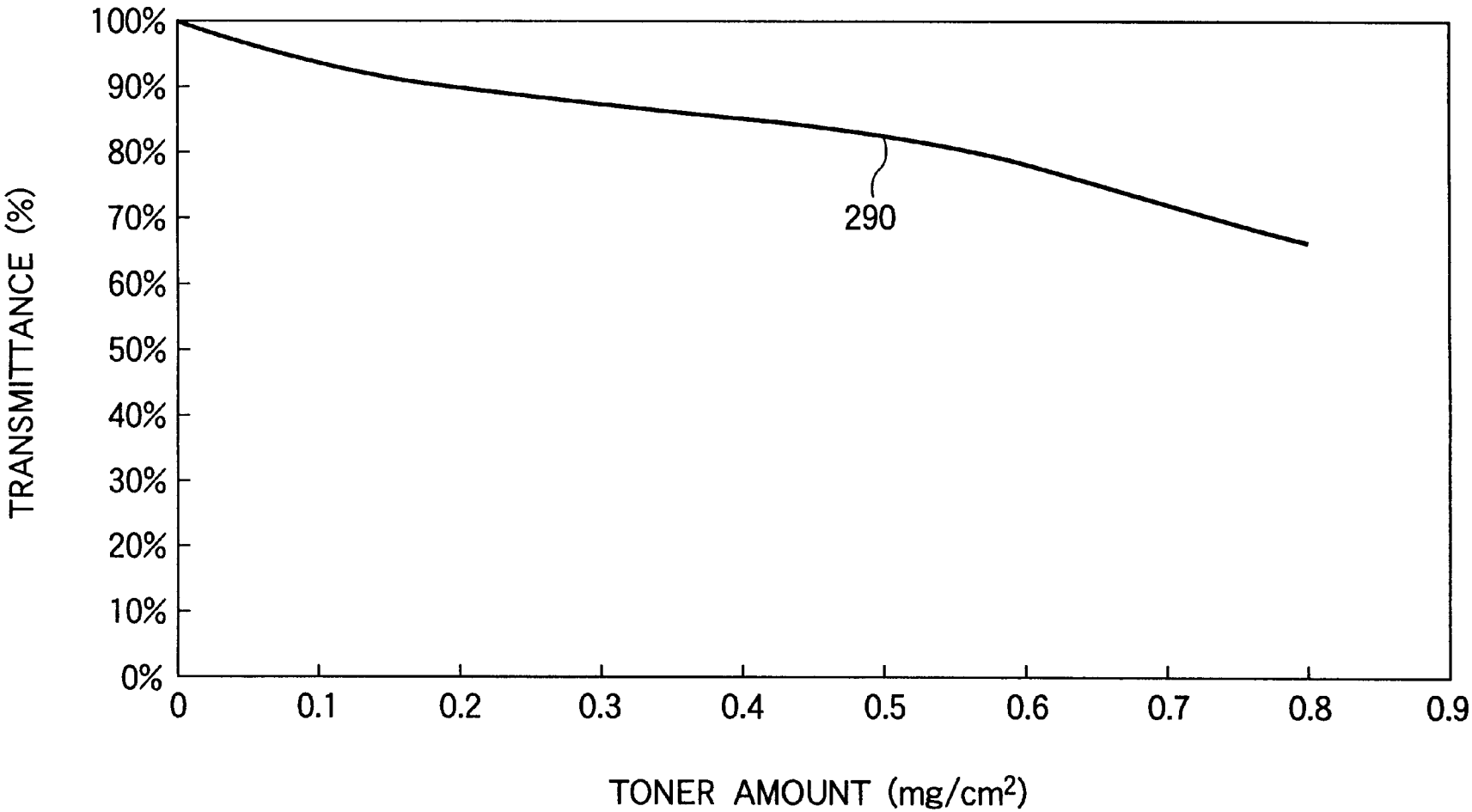
FIG. 33 is a graph to represent the transmittance of secondary exposure light passing through the photosensitive body surface when magenta toner is used in the fifth embodiment the invention.
Figure 34:
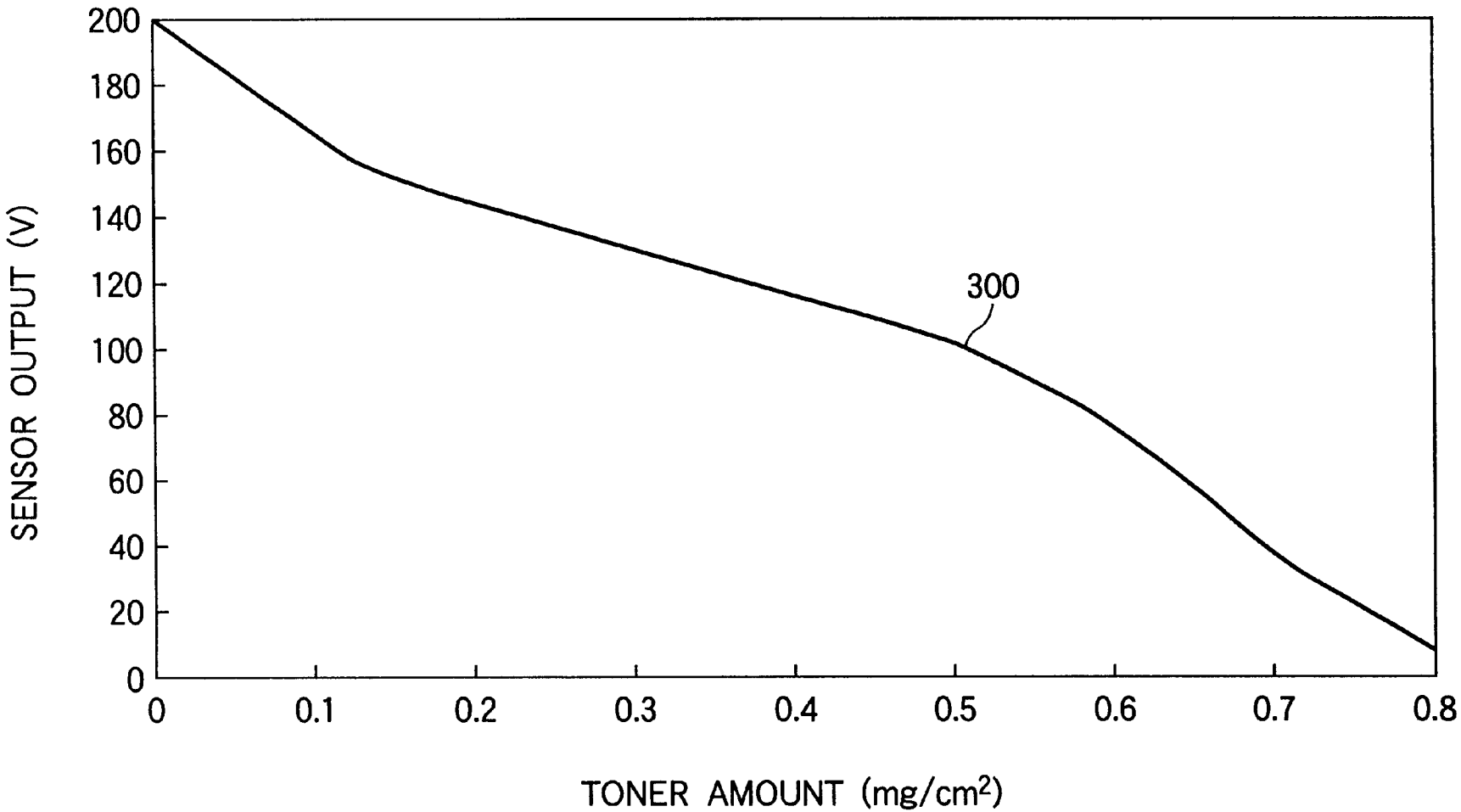
FIG. 34 is a graph to represent the measurement sensitivity when magenta toner is used in the fifth embodiment of the invention.

FIG. 33 is a graph to represent the transmittance of secondary exposure light passing through the photosensitive body surface when magenta toner is used in the fifth embodiment of the invention. FIG. 34 is a graph to represent the measurement sensitivity when magenta toner is used in the fifth embodiment of the invention.

The graph of FIG. 33 shows the transmittance on the vertical axis and the graph of FIG. 34 shows the potential difference provided by sensor output on the vertical axis. Each graph shows the toner amount on the horizontal axis.

Curves 290 and 300 in the graphs do not contain horizontal portions of the curves 240 and 250 in the graphs of FIGS. 22 and 23 and each has an almost even inclination from a low toner amount area to a high toner amount area. Therefore, the potential difference of the photosensitive body caused by the secondary exposure light decreases uniformly with an increase in the amount of toner deposited on the photosensitive roll, and in the fifth embodiment of the invention, high measurement sensitivity can be provided over a wide range of toner amount areas.

FIGS. 33 and 34 are graphs applied when magenta toner is used; however, it is expected that similar results are produced if any other color toner or black toner is used.

Sixth Embodiment

Figure 35:
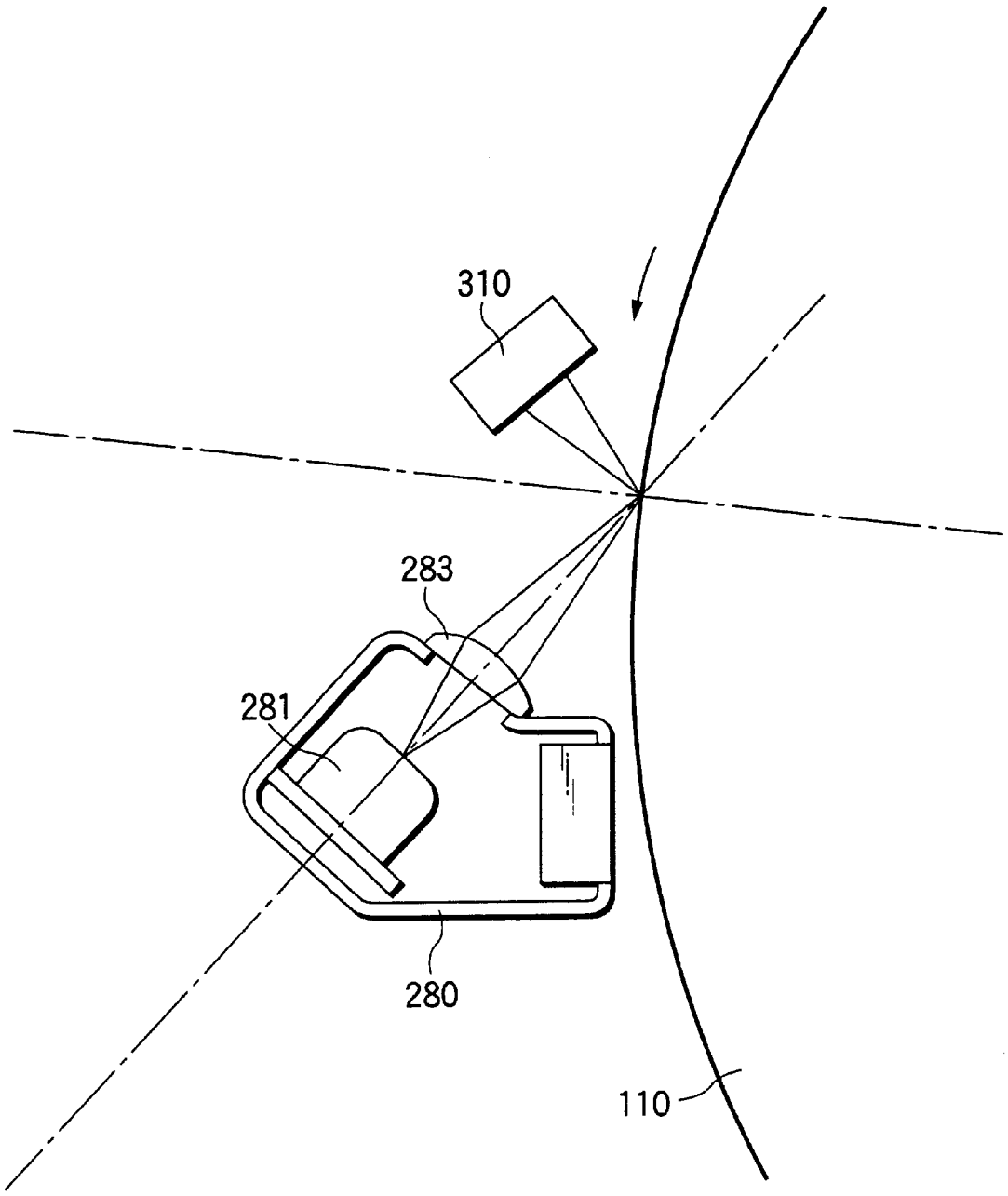
FIG. 35 is a drawing to show the configuration of a sensor unit in a sixth embodiment of the invention.

FIG. 35 is a drawing to show the configuration of a sensor unit in a sixth embodiment of the invention.

The sixth embodiment is almost similar to the fifth embodiment except that it comprises a light reception section 310 for receiving light applied to the surface of a photosensitive roll 110 by a laser diode 281 and reflected on the surface of the photosensitive roll 110 and except that the above-described controller derives the toner amount based also on the amount of light received by the light reception section 310. The controller may derive the toner amount based on both the potential difference and the light reception amount or may derive the toner amount based only on either of them temporarily. In the sixth embodiment, the laser diode 281 applies light of a divergent light flux or a convergent light flux to the surface of the photosensitive roll 110 through a lens 283, thereby providing applied light out of a Brewster angle, fitted to toner amount measurement using specularly reflected light.

In the sixth embodiment, toner amount measurement using specularly reflected light and toner amount measurement based on the surface potential are used in combination, whereby the toner amount is measured with high accuracy over a wide range of low toner amounts to high toner amounts.

Seventh Embodiment

Figure 36:
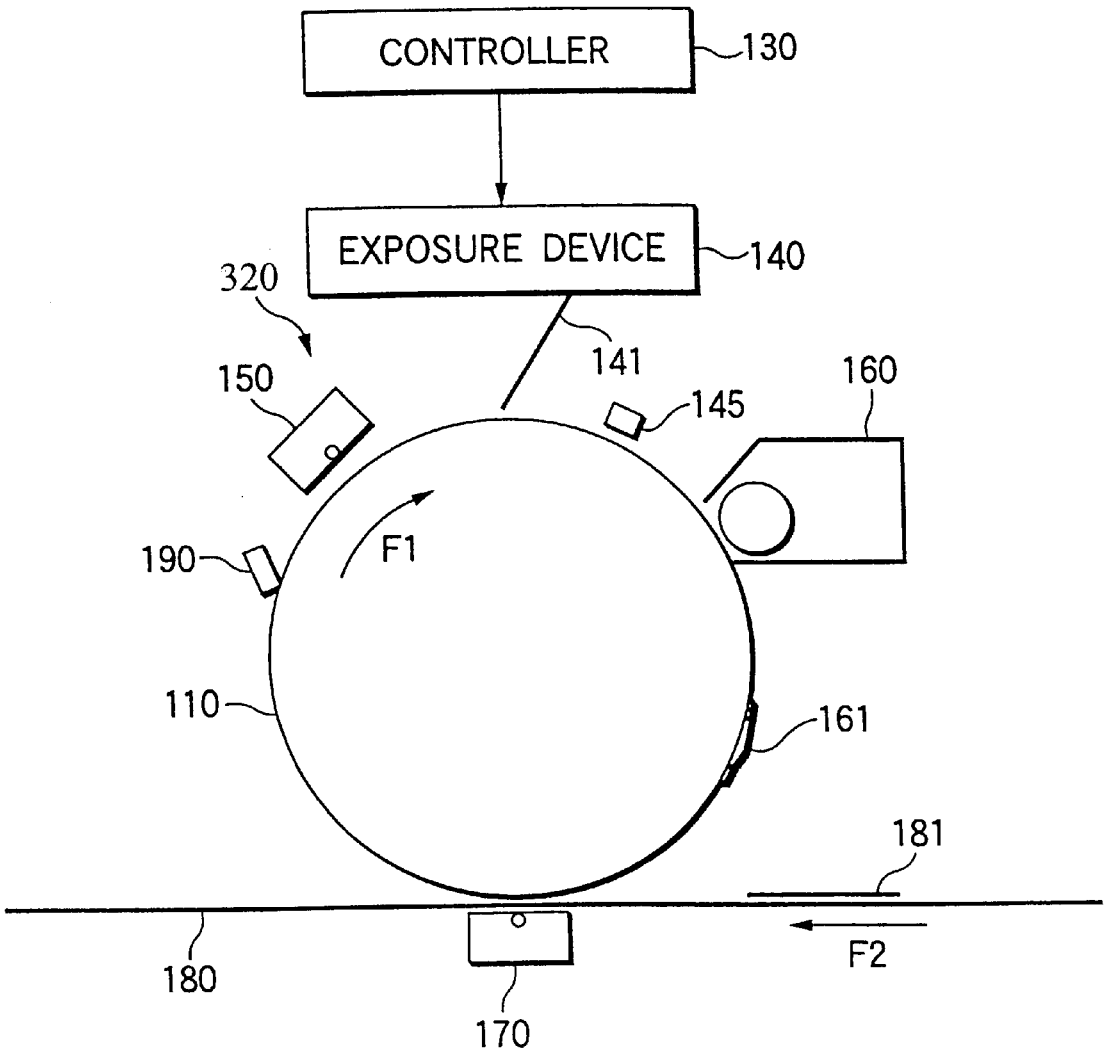
FIG. 36 is a drawing to show the configuration of a seventh embodiment of the invention.

FIG.36 is a drawing to show the configuration of a seventh embodiment of the invention.

In the first to sixth embodiments described above, the sensor box is incorporated to execute the toner amount measurement method of the invention; in the seventh embodiment, a component built in an existing image formation apparatus is also used to execute the toner amount measurement method of the invention.

An image formation apparatus 320 shown in FIG. 36 has a configuration almost similar to that of the image formation apparatus shown in FIG. 17 except that it does not comprise the sensor box. In the image formation apparatus 320 shown in FIG. 36, a laser exposure device 140 serves as both a first light application section and a second light application section mentioned in the invention. An existing surface potential sensor 145 also serves as a potential measurement section mentioned in the invention.

Figure 37:
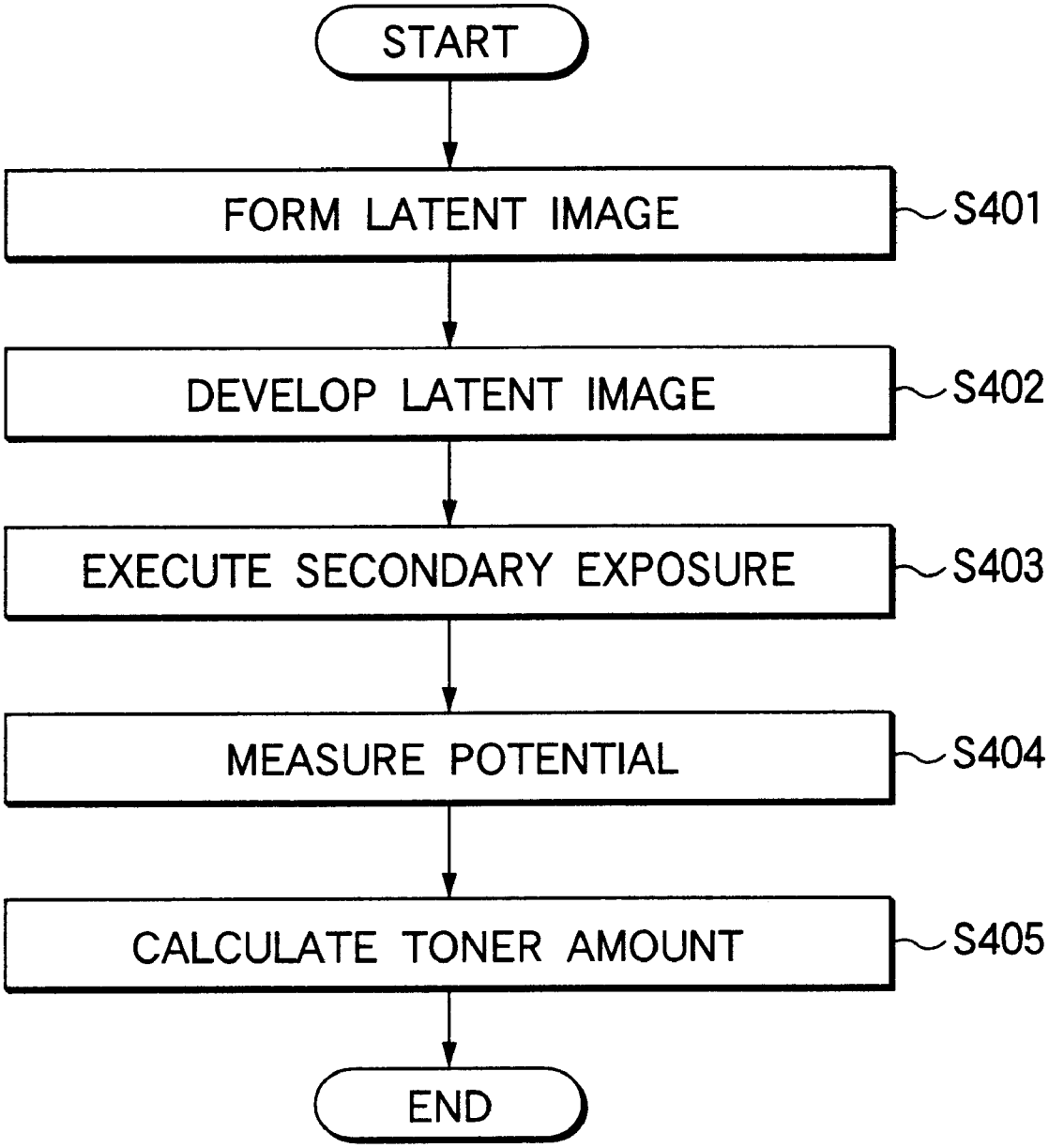
FIG. 37 is a flowchart to represent the operation of the seventh embodiment of the invention.

FIG. 37 is a flowchart to represent the operation of the seventh embodiment of the invention.

In the seventh embodiment, first an electrostatic latent image is formed by the laser exposure device 140 (step S401) and is developed by a developing device 160 (step S402) for forming a developed toner image 161.

As a photosensitive roll 110 rotates forward or backward, the developed toner image 161 is transported to a position facing the laser exposure device 140 and secondary exposure light is applied by the laser exposure device 140 (step S403). When the photosensitive roll 110 rotates forward or backward, a cleaner is placed away from the photosensitive roll 110 or a charger is stopped as required. Then, the surface potential is measured with the surface potential sensor 145 (step S404) and measurement data is sent to a controller for calculating the toner amount based on the measurement data (step S405).

Such an operation sequence is performed, whereby the toner amount measurement method of the invention is executed.

As described above, according to the invention, the toner amount can be measured on a photosensitive body for a toner image having a high toner amount, formerly hard to measure the toner amount of the toner image.

What is claimed is:

1. An image formation apparatus comprising:

a photosensitive body;

a first light application section for applying first light to a surface of the photosensitive body to form an electrostatic latent image;

a developing section for depositing toner on the electrostatic latent image to develop the electrostatic latent image and form a developed image;

a transfer section for finally transferring the developed image onto a paper, thereby forming a toner image on the paper, wherein at least any one of the photosensitive body, the first light application section, the developing section, and the transfer section conforms to an image formation condition that can be controlled;

a second light application section for applying second light to the surface of the photosensitive body on which the toner is deposited;

a potential measurement section for measuring a surface potential of the photosensitive body to which the light is applied by the second light application section;

a toner amount derivation section for deriving the toner amount on the photosensitive body based on the surface potential measured by the potential measurement section; and a condition control section for controlling the image formation condition in response to the toner amount derived by the toner amount derivation section.

2. The image formation apparatus as claimed in claim 1, wherein the potential measurement section measures the surface potentials inside and outside the area to which the second light is applied by the second light application section; and the toner amount derivation section derives the toner amount on the photosensitive body based on the difference between the surface potentials inside and outside the area.

3. The image formation apparatus as claimed in claim 1, further comprising a light amount adjustment section for predicting a toner amount on the photosensitive body and adjusting the amount of second light applied by the second light application section to a light amount responsive to the predicted toner amount.

4. The image formation apparatus as claimed in claim 1, the image formation apparatus further comprising a light amount adjustment section for once adjusting the amount of second light applied by the second light application section to a predetermined light amount or less and then again adjusting the amount of second light applied by the second light application section to a light amount responsive to the toner amount derived by the toner amount derivation section.

5. The image formation apparatus as claimed in claim 1, wherein the second light application section applies the second light having a wavelength absorbable to the toner.

6. The image formation apparatus as claimed in claim 1, wherein the second light application section applies the second light of p polarization to the surface of the photosensitive body from a direction crossing the surface of the photosensitive body at a Brewster angle.

7. The image formation apparatus as claimed in claim 6, wherein the second light application section applies the second light of a collimated light flux.

8. The image formation apparatus as claimed in claim 6, wherein the second light application section applies the second light of a divergent light flux or a convergent light flux.

9. The image formation apparatus as claimed in claim 1, further comprising a light reception section for receiving the second light applied to the surface of the photosensitive body and reflected on the surface of the photosensitive body, wherein the toner amount derivation section derives the toner amount based also on the amount of light received by the light reception section.

10. The image formation apparatus as claimed in claim 1, wherein the first light application section also serves as the second light application section.

11. A toner amount measurement apparatus comprising:

a light application section for applying light to a surface of a photosensitive body supporting toner on the surface;

a potential measurement section for measuring a surface potential of the photosensitive body to which the light is applied by the light application section; and a toner amount derivation section for deriving the toner amount on the photosensitive body based on the surface potential measured by the potential measurement section.

12. The toner amount measurement apparatus as claimed in claim 11, wherein the potential measurement section measures the surface potentials inside and outside the area to which the light is applied by the light application section; and the toner amount derivation section derives the toner amount on the photosensitive body based on the difference between the surface potentials inside and outside the area.

13. The toner amount measurement apparatus as claimed in claim 11, further comprising a light amount adjustment section for predicting a toner amount on the photosensitive body and adjusting the amount of light applied by the light application section to a light amount responsive to the predicted toner amount.

14. The toner amount measurement apparatus as claimed in claim 11, further comprising a light amount adjustment section for once adjusting the amount of light applied by the light application section to a predetermined light amount or less and then again adjusting the amount of light applied by the light application section to a light amount responsive to the toner amount derived by the toner amount derivation section.

15. The toner amount measurement apparatus as claimed in claim 11, wherein the light application section applies the light having a wavelength absorbable to the toner.

16. The toner amount measurement apparatus as claimed in claim 11, wherein the light application section applies the light of p polarization to the surface of the photosensitive body from a direction crossing the surface of the photosensitive body at a Brewster angle.

17. The toner amount measurement apparatus as claimed in claim 16, wherein the light, application section applies the light of a collimated light flux.

18. The toner amount measurement apparatus as claimed in claim 16, wherein the light application section applies the light of a divergent light flux or a convergent light flux.

19. The toner amount measurement apparatus as claimed in claim 11, further comprising a light reception section for receiving the light applied to the surface of the photosensitive body and reflected on the surface of the photosensitive body, wherein the toner amount derivation section derives the toner amount based also on the amount of light received by the light reception section.

20. A toner amount measurement method comprising:

applying light to a surface of a photosensitive body supporting toner on the surface;

measuring a surface potential of the photosensitive body to which the light is applied at the light application step; and deriving the toner amount on the photosensitive body based on the surface potential measured at the potential measurement step.

21. The toner amount measurement method as claimed in claim 20, wherein the potential measurement step measures the surface potentials inside and outside the area to which the light is applied; and the deriving step derives the toner amount on the photosensitive body based on the difference between the surface potentials inside and outside the area.

22. The toner amount measurement method as claimed in claim 20, further comprising:

predicting a toner amount on the photosensitive body; and adjusting the amount of light applied to a light amount responsive to the predicted toner amount.

23. The toner amount measurement method as claimed in claim 20, further comprising:

adjusting the amount of light applied to a predetermined light amount or less; and then adjusting the amount of light applied to a light amount responsive to the toner amount derived.

24. The toner amount measurement method as claimed in claim 20, wherein the light applying step applies the light having a wavelength absorbable to the toner.

25. The toner amount measurement method as claimed in claim 20, wherein the light applying step applies the light of p polarization to the surface of the photosensitive body from a direction crossing the surface of the photosensitive body at a Brewster angle.

26. The toner amount measurement method as claimed in claim 25, wherein the light applying step applies the light of a collimated light flux.

27. The toner amount measurement method as claimed in claim 25, wherein the light applying step applies the light of a divergent light flux or a convergent light flux.

28. The toner amount measurement method as claimed in claim 20, further comprising a receiving step of receiving the light applied to the surface of the photosensitive body and reflected on the surface of the photosensitive body, wherein the deriving step derives the toner amount based also on the amount of light received.

* * * * *